US011195472B2

(12) United States Patent
Cho et al.

(10) Patent No.: US 11,195,472 B2
(45) Date of Patent: Dec. 7, 2021

(54) DISPLAY DEVICE

(71) Applicant: LG Display Co., Ltd., Seoul (KR)

(72) Inventors: Youngsung Cho, Paju-si (KR); Byeongseong So, Paju-si (KR); Hyunguk Jang, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/091,810

(22) Filed: Nov. 6, 2020

(65) Prior Publication Data

US 2021/0142735 A1 May 13, 2021

(30) Foreign Application Priority Data

Nov. 13, 2019 (KR) ..... 10-2019-0145455

(51) Int. Cl.
*G09G 3/3233* (2016.01)
*G09G 3/3266* (2016.01)

(52) U.S. Cl.
CPC ... *G09G 3/3266* (2013.01); *G09G 2300/0842* (2013.01); *G09G 2310/066* (2013.01); *G09G 2320/0233* (2013.01)

(58) Field of Classification Search
CPC ..... G09G 3/3233; G09G 3/3266; G09G 2300/0861; G09G 2320/045; G09G 2320/0295
See application file for complete search history.

(56) References Cited

U.S. PATENT DOCUMENTS

| | | | | |
|---|---|---|---|---|
| 2017/0221422 | A1* | 8/2017 | Hwang | G09G 3/3291 |
| 2018/0033370 | A1* | 2/2018 | Zheng | G09G 3/3233 |
| 2018/0190197 | A1* | 7/2018 | Chang | G09G 3/3233 |
| 2021/0201759 | A1* | 7/2021 | Cho | G09G 3/30 |
| 2021/0201782 | A1* | 7/2021 | Jang | G09G 3/3233 |

* cited by examiner

*Primary Examiner* — Dennis P Joseph
(74) *Attorney, Agent, or Firm* — Polsinelli PC

(57) ABSTRACT

A display device includes a display panel, a data driving circuit, a gate driving circuit, and a timing controller, each pixel of the display panel includes a light-emitting diode, a driving transistor, second to sixth switching transistors, and a storage capacitor, and at a sensing step at which the light-emitting diode does not emit light, a conduction path that is connected through the sixth switching transistor, the driving transistor, the second switching transistor, and the third switching transistor is formed, and an electrical signal reflecting a threshold voltage of one of the second to fourth switching transistors is transferred to a data line through the conduction path.

11 Claims, 17 Drawing Sheets

| | |
|---|---|
| n1 | – |
| n2 | – |
| n3 | – |

| | |
|---|---|
| n1 | Vini1 |
| n2 | Vini1-Vth |
| n3 | Vini1-Vth |

| | |
|---|---|
| n1 | Vdata+Vth |
| n2 | Vdata |
| n3 | - |

| | |
|---|---|
| n1 | Vdata+Vth |
| n2 | Vdata |
| n3 | Vdd |

DISPLAY DEVICE

CROSS-REFERENCE TO RELATED APPLICATION

The present application claims priority to Korean Patent Application No. 10-2019-0145455, filed on Nov. 13, 2019, which is hereby incorporated by reference in its entirety.

BACKGROUND

Field of the Disclosure

The present disclosure relates to a display device and more particularly to a display device capable of detecting a threshold voltage of a switching transistor of a pixel circuit.

Description of the Background

There are flat panel displays such as liquid crystal displays (LCDs), electroluminescence displays (ELDs), field emission displays (FEDs), and quantum dot displays (QDDs). The field emission displays (FEDs) can be classified into inorganic light-emitting displays and organic light-emitting displays according to the material of an emissive layer. An organic light-emitting diode (OLED) display device displays an image using pixels each including an organic light-emitting diode (OLED) that is a self-emissive element.

An OLED display device includes a matrix of pixels each including an OLED. In the OLED display device, the brightness of each pixel, which corresponds to the amount of light emitted from the corresponding OLED, changes according to a gray scale data of an image. Each pixel circuit includes an OLED that is a light-emissive element, a switching transistor which is made of a thin film transistor (TFT) and controls application of a data voltage corresponding to a gray scale level to the OLED, a driving transistor to control a pixel current flowing through the OLED according to a gate-source voltage which is a voltage applied between the gate and the source of the driving transistor, and a capacitor to store electrical energy corresponding to the data voltage, and a plurality of switching transistors for sensing the threshold voltage of the driving transistor, controlling emission of light, and controlling initialization.

The characteristics of both the driving transistor and the switching transistor are likely to deteriorate with time, and the deterioration may vary from pixel to pixel. That is, the threshold voltages of the switching transistors of the respective pixels may become non-uniform. In this case, when image data is input to such pixels to express the same gray scale level, since different data voltages are applied to the driving transistors of the respective pixels, the gray scale levels expressed by the pixels are not uniform.

SUMMARY

Accordingly, the present disclosure is made in view of the problems occurring in the prior art and is to provide a display device capable of detecting and correcting the threshold voltage of a switching transistor.

A display device according to one aspect of the present disclosure includes: a display panel including a plurality of pixels, each connected to a gate line and a data line; a data driving circuit configured to drive the data line; a gate driving circuit configured to drive the gate line; and a timing controller configured to control operation of the data driving circuit and operation of the gate driving circuit.

In the display device, each of the pixels includes: a light-emitting diode; a driving transistor having a second electrode connected to an anode electrode of the light-emitting diode, the driving transistor allowing a driving current corresponding to a data voltage supplied through the data line to flow through the light-emitting diode; a second switching transistor that controls connection between a first electrode of the driving transistor and a second node; a third switching transistor that controls connection between the data line and the second node and which operates according to a second scan signal that is later than a first scan signal that controls operation of the second switching transistor; a fourth switching transistor that controls connection between a first initialization voltage input terminal for supplying a first initialization voltage and a gate electrode of the driving transistor and which operates according to the first scan signal; a fifth switching transistor that controls connection between the first electrode and a first power input terminal for supplying a high-potential supply voltage; a sixth switching transistor that controls connection between a second initialization voltage input terminal for supplying a second initialization voltage and the anode electrode and which operates according to a third scan signal having the same timing as the first scan signal; and a storage capacitor connected between the second node and the gate electrode.

At a sensing step at which the light-emitting diode does not emit light, a conduction path that is connected through the sixth switching transistor, the driving transistor, the second switching transistor, and the third switching transistor is formed, and an electrical signal reflecting a threshold voltage of one of the second to fourth switching transistors is transferred to the data line through the conduction path.

Accordingly, it is possible to compensate for deterioration of the switching transistors implemented with oxide semiconductor elements.

In addition, it is possible to easily and precisely detect the threshold voltages of the switching transistors by using a voltage sensing method using the data line.

In addition, it is possible to improve display quality of an organic light-emitting display device by compensating for the deterioration of the switching transistors.

BRIEF DESCRIPTION OF THE DRAWINGS

The above features and other advantages of the present disclosure will be more clearly understood from the following detailed description taken in conjunction with the accompanying drawings, in which.

DETAILED DESCRIPTION

Figure 1:
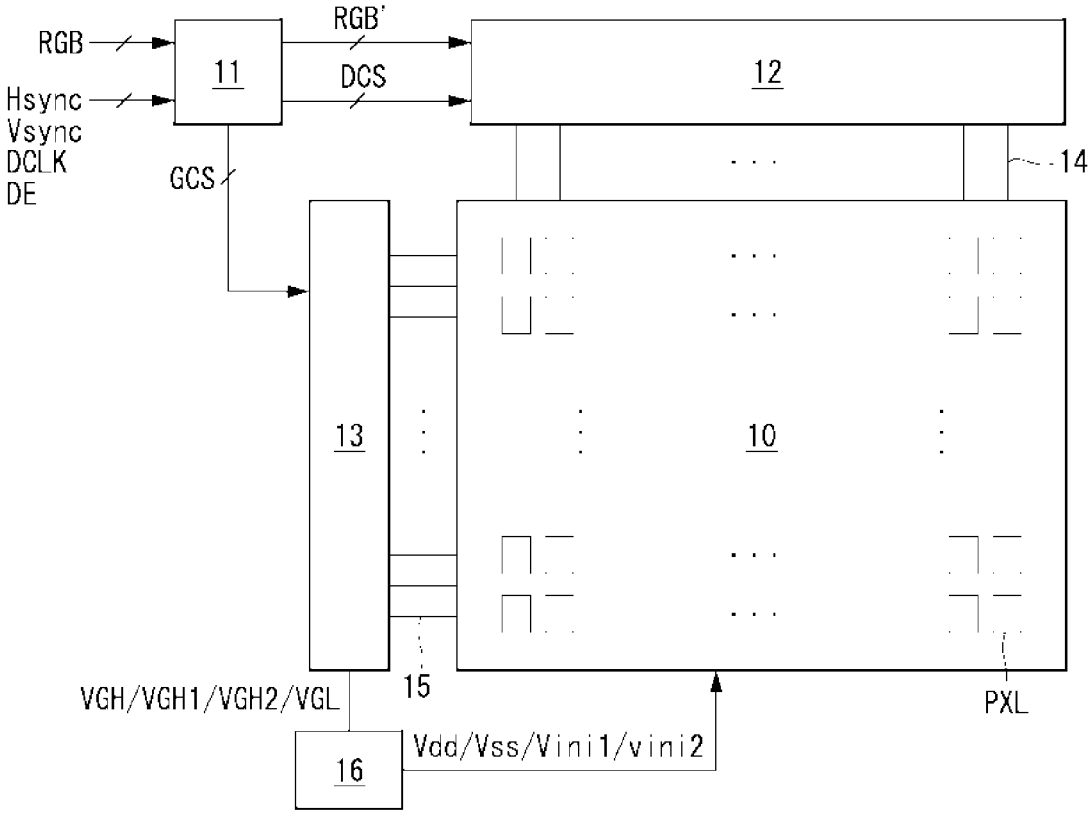
FIG. 1 is a block diagram of an organic light-emitting diode (OLED) display device.

The present disclosure will be described below with reference to the accompanying drawings. Throughout the drawings and present disclosure, like reference symbols denote substantially like components, respectively. In the description below, when a detailed description of a known function or configuration in the related art is likely to obscure the gist of the present disclosure, description of the known function or configuration will be omitted.

In a display device, a pixel circuit and a gate driving circuit each include one or more transistors that are n-channel transistors and/or p-channel transistors. A transistor is a three-terminal device including a gate electrode, a source electrode, and a drain electrode. The source electrode supplies charge carriers to the transistor. That is, charge carriers enter the transistor through the source electrode and flow out of the transistor through the drain electrode. That is, in the transistor, charge carriers move from the source electrode to the drain electrode. An n-channel transistor is biased such that the source electrode is at a lower potential than the drain electrode so that electrons as charge carriers can move from the source electrode to the drain electrode. That is, in the n-channel transistor, an electric current flows from the drain electrode to the source electrode. A p-channel transistor is biased such that the source electrode is at a higher potential than the drain electrode so that holes as charge carriers can move from the source electrode to the drain electrode. That is, in the p-channel transistor, an electric current flows from the source electrode to the drain electrode. The terms "source" and "drain" are concepts that are relatively decided according to voltages applied thereto. Therefore, the scope of the present disclosure is not limited by the terms "source" and "drain". Hereinafter, the terms "first and second electrodes" are used instead of the terms "source and drain electrodes".

A scan signal (also called "gate signal") applied to each pixel swings between a gate-on voltage and a gate-off voltage. The gate-on voltage is set to be higher than the threshold voltage of a transistor and the gate-off voltage is set to be lower than the threshold voltage of the transistor. The transistor turns on in response to the gate-on voltage and turns off in response to the gate-off voltage. In the case of an n-channel transistor, the gate-on voltage may be a gate high voltage VGH and the gate-off voltage may be a gate low voltage VGL. On the contrary, in the case of a p-channel transistor, the gate-on voltage may be a gate low voltage VGL and the gate-off voltage may be a gate high voltage VGH.

Each pixel of an organic light-emitting display device includes an organic light-emitting diode (OLED) and a driving element that drives the OLED by supplying a current according to a gate-source voltage Vgs thereof. The OLED includes an anode electrode, a cathode electrode, and a film of organic compound situated between the anode electrode and the cathode electrode. The film of organic compound includes a hole injection layer (HIL), a hole transport layer (HTL), an emission layer (EML), an electron transport layer (ETL), and an electron injection layer (EIL), but the configuration of the film of organic compound is not limited thereto. When electric current flows through the OLED, holes passing through the HTL and electrons passing through the ETL move into the EML and combine to produce excitons. When the excitons change from an excited state to a ground state, visible light rays are emitted.

The driving transistor may be implemented with a transistor such as a metal oxide semiconductor field effect transistor (MOSTET). The electric characteristics of the driving transistors need to be uniform from pixel to pixel. However, the electric characteristics of the driving transistors of the respective pixels may not be uniform due to process variation and characteristic variation, or may change with time during the use of the display device. In order to compensate for variation in the electric characteristics of the driving transistors, an internal compensation scheme and/or an external compensation scheme is used. It is assumed that aspects described below use an internal compensation scheme.

Recently, attempts to use oxide transistors as transistors included in a pixel circuit of a light-emitting display device have been increasingly made. Oxide transistors use an oxide such as IGZO that is a compound of indium (In), gallium (Ga), zinc (Zn), and oxygen (O), as a semiconductor material, instead of silicon.

Oxide transistors exhibit lower electron mobility than poly-silicon transistors but ten times higher electron mobility than amorphous-silicon transistors. In addition, the manufacturing cost of oxide transistors is higher than that of poly silicon transistors but is much lower than that of amorphous silicon transistors.

In addition, since manufacturing processes of oxide transistors are similar to those of amorphous silicon transistors, existing equipment and facilities can be used to manufacture oxide transistors. For these reasons, oxide transistors are used in high-resolution and large-size liquid crystal displays that require low power consumption or OLED TVs that cannot be implemented with low-temperature poly silicon-based processes.

FIG. 1 is a block diagram illustrating an organic light-emitting display device which includes a display panel 10, a timing controller 11, a data driving circuit 12, a gate driving circuit 13, and a power supply unit 16.

The timing controller 11, the data driving circuit 12, the gate driving circuit 13, and the power supply unit 16 are partially or entirely integrated into a driver IC.

The display panel 10 has a screen region in which an image is to be displayed. The screen region is provided with multiple data lines 14 each extending in a column direction (or vertical direction) and multiple gate lines 15 each extending in a row direction (or horizontal direction). The data lines 14 and the gate lines 15 cross each other, and each crossing point is provided with a pixel PXL. That is, in the screen region, multiple pixels are arranged in matrix.

The gate line lines 15 includes two or more scan signal lines for delivering scan signals and an emission signal lime for delivering an emission signal. The scan signals enable a data voltage applied through the data line 14 and an initialization voltage applied through an initialization voltage line to be supplied to the pixels PXL, and the emission causes the pixels PXL to emit light.

The display panel 10 may further include a first power line for transferring a pixel voltage (also called high-potential drive voltage) Vdd to the pixels PXL, a second power line for transferring a low-potential drive voltage Vss to the pixels PXL, and an initialization voltage line for transferring an initialization voltage Vini to the pixels PXL. The first and second power lines and the initialization voltage line are connected to the power supply unit 16. The second power line is a transparent electrode that covers the multiple pixels PXL.

Touch sensors are disposed on the array of pixels in the display panel 10. Touch inputs are sensed by the touch sensors or pixels. On-cell-type or add-on-type touch sensors are arranged on a screen AA of the display panel and in-cell-type touch sensors are arranged inside the array of pixels.

In the array of pixels, the pixels PXL arranged on the same horizontal line are connected to one of the data lines 14 and one of the gate lines 15, thereby forming a pixel line. Alternatively, the pixels PXL on the same horizontal line are connected to one of the data lines 14 and two or more gate lines 15, thereby forming a pixel line. Each of the pixels PXL is electrically connected to the corresponding data line 14 in response to a scan signal and an emission signal applied to the corresponding gate line 15, thereby receiving a data voltage which causes the OLED in the pixel to emit light according to an electric current corresponding to the data voltage. The pixels PXL of the same pixel line simultaneously operate according to the scan signal and the emission signal that are applied to the same gate line 15.

A single pixel is composed of three sub-pixels including a red sub-pixel, a green sub-pixel, and a blue sub-pixel. Alternatively, a single pixel is composed of four sub-pixels including a red sub-pixel, a green sub-pixel, a blue sub-pixel, and a white sub-pixel. However, the configuration of a single pixel is not limited thereto. Each sub-pixel is implemented with a pixel circuit including an internal compensation circuit. Hereinbelow, a pixel refers to a sub-pixel.

Figure 2:
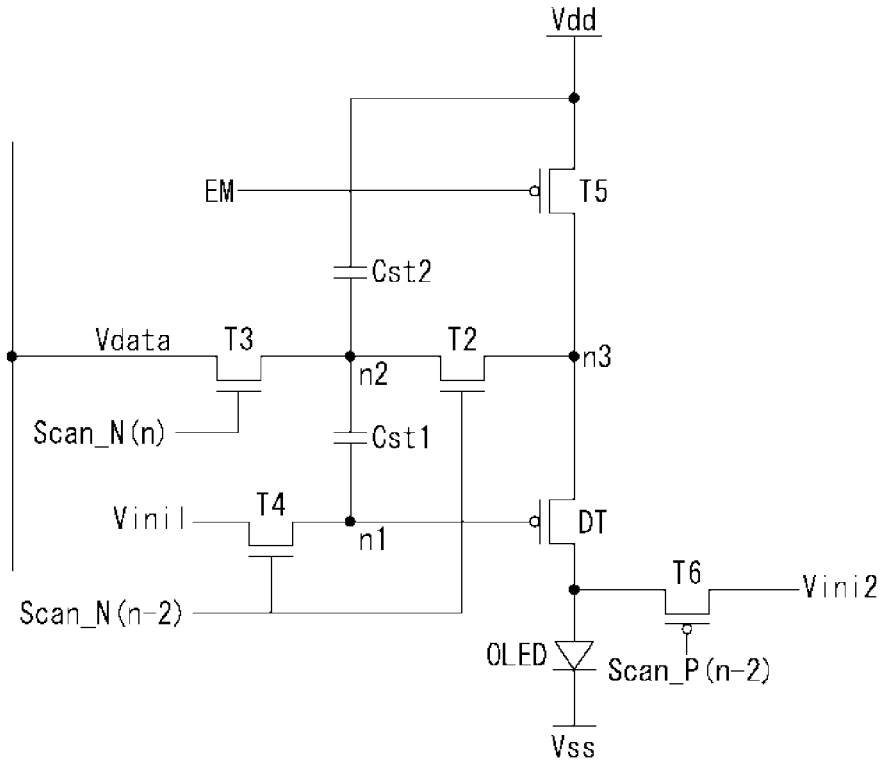
FIG. 2 is a circuitry diagram illustrating a pixel circuit including a switching transistor made of an oxide semiconductor.

Each pixel PXL receives a high-potential drive voltage Vdd, a first/second initialization voltage Vini1/Vini2, and a low-potential supply voltage Vss. The pixel circuit includes a driving transistor, an OLED, and an internal compensation circuit. Referring to FIG. 2, the internal compensation circuit is composed of a plurality of switching transistors and one or more capacitors.

The timing controller 11 allows image data RGB to be supplied to the data driving circuit 12 from an external host system (not illustrated). The timing controller 11 receives timing signals such as a vertical synchronization signal Vsync, a horizontal synchronization signal Hsync, a data enable signal DE, and a dot clock signal DCLK from a host system, and generates control signals to control operation timing of the data driving circuit 12 and the gate driving circuit 13. The control signals includes a gate timing control signal GCS for controlling operation timing of the gate driving circuit 13 and a data timing control signal DCS for controlling operation timing of the data driving circuit 12.

According to the data timing control signal DCS input from the timing controller 11, the data driving circuit 12 samples and latches the image data RGB which is digital video data, converts the image data RGB into parallel data, converts the parallel data into an analog data voltage according to a gamma reference voltage through channels, and supplies the analog data voltage to the pixels PXL through an output channel and the data lines 14. The data voltage may be values corresponding to grayscale levels to be expressed by the pixels PXL. The data driving circuit 12 may be composed of a plurality of driver ICs.

The data driving circuit 12 may include a shift register, a latch, a level shifter, a digital-to-analog converter (DAC), and a buffer. The shift register shifts the clock input from the timing controller 11 and sequentially outputs sampling clocks. The latch samples and latches digital video data or pixel data according to the sampling clocks sequentially input from the shift register, and outputs the sampled pixel data. The level shifter shifts the voltage of the pixel data input from the latch into the input voltage range of the DAC. The DAC converts the pixel data input from the level shifter into a data voltage on the basis of a gamma correction voltage and outputs the data voltage. The data voltage output from the DAC is supplied to the data line 14 through the buffer.

The data driving circuit 12 may sense the threshold voltages of the respective switching transistors constituting the pixel PXL and transmit sensing data SD to the timing controller 11. The timing controller 11 corrects the image data RGB on the basis of the sensing data SD so as to compensate for a change in the threshold voltage of the switching transistor included in the pixel and supplies the resulting corrected image data RGB' to the data driving circuit 12.

The gate driving circuit 13 generates a scan signal and an emission signal on the basis of the gate control signal GCS. Specifically, the gate driving circuit 13 generates a scan signal and an emission signal row by row during an active period and sequentially supplies them to the gate line 15 for each pixel line. The scan signal and the emission signal supplied to the gate line 15 are synchronized with the supply of the data voltage to the data line 14. The scan signal and the emission signal swing between a gate-on voltage VGL and a gate-off voltage VGH. When sensing the threshold voltage of a switching transistor, the gate-on voltage that turns on the switching transistor may be changed.

The gate driving circuit 13 may be composed of a plurality of gate drive ICs each including a shift register, a level shifter for converting the output signal of the shift register to have a swing width suitable for TFT driving of the pixel, an output buffer, etc. Alternatively, the gate driving circuit 13 may be formed in a gate-drive-IC-in-panel manner (GIP) in which the gate driving circuit 13 is directly formed on a lower substrate of the display panel 10. When the GIP scheme is used, the level shifter is mounted on a printed circuit board (PCB), and the shift register is formed on the lower substrate of the display panel 10.

The power supply unit 16 adjusts a direct current (DC) input voltage provided by the host with the use of a DC-DC converter to provide gate-on and gate-off voltages VGH, VGH1, VGH2, and VGL which are required for operation of the data driving circuit 12 and operation of the gate driving circuit 13. In addition, the power supply unit 16 generates a high-potential drive voltage Vdd, an initialization voltage Vini, and a low-potential drive voltage Vss required to drive the array of pixels.

The host system may be an application processor (AP) in a mobile device, a wearable device, or a virtual/augmented reality device. Alternatively, the host system may be a main board of a television system, a set top box, a navigation system, a personal computer, or a home theater system, but is not limited thereto.

FIG. 2 illustrates a pixel circuit using an oxide semiconductor as a switching transistor. The pixel circuit is composed of six transistors and two capacitors. The pixel circuit compensates for a change in the threshold voltage of a driving transistor thereof with the use of an internal compensation circuit.

The pixel circuit may be composed of a driving transistor DT, a light-emitting diode (OLED), and an internal compensation circuit. The internal compensation circuit may be composed of five switching transistors and two capacitors, in which at least part of the switching transistors are oxide transistors.

The driving transistor DT functions to generate a current corresponding to a data voltage Vdata to cause the OLED to emit light according to the current. The driving transistor DT includes a first electrode connected to a third node n3, a second electrode connected to an anode electrode of the OLED, and a gate electrode connected to a first node n1.

A second switching transistor T2 functions to store the threshold voltage of the driving transistor DT in a second node n2. The second switching transistor T2 includes a gate electrode, a first electrode, and a second electrode. One of the first and second electrodes is connected to the second node n2 and the other is connected to the third node n3. The gate electrode is supplied with a first scan signal Scan_N (n−2).

A third switching transistor T3 functions to transfer the data voltage Vdata of the data line 13 to the second node n2. The third switching transistor T3 includes a first electrode, a second electrode, and a gate electrode. One of the first electrode and the second electrode is connected to the data line 13, the other is connected to the second node n2, and the gate electrode is supplied with a second scan signal Scan_N (n).

A fourth switching transistor T4 functions to transfer a first initialization voltage Vini1 to the gate electrode of the driving transistor DT. That is, the fourth switching transistor T4 transfers the first initialization voltage Vini1 to the first node n1. One of the first electrode and the second electrode of the fourth switching transistor T4 is supplied with the first initialization voltage Vini1, the other is connected to the first node n2, and the gate electrode is supplied with the first scan signal Scan_N(n−2).

A fifth switching transistor T5 functions to control the light emission of the OLED. The fifth switching transistor T5 includes a first electrode, a second electrode, and a gate electrode. One of the first electrode and the second electrode is supplied with a high-potential supply voltage Vdd, the other is connected to the third node n3, and the gate electrode is supplied with the emission signal EM.

A sixth switching transistor T6 functions to supply a second initialization voltage Vini2 to the anode electrode of the OLED. The sixth switching transistor T6 includes a first electrode, a second electrode, and a gate electrode. One of the first electrode and the second electrode is connected to the anode electrode of the OLED, the other is supplied with the second initialization voltage Vini2, and the gate electrode is supplied with a third scan signal Scan_P(n−2)).

A first storage capacitor Cst1 is connected between the first node n1 and the second node n2 and stores the threshold voltage of the driving transistor DT.

A second storage capacitor Cst2 has a first electrode and a second electrode. One of the first electrode and the second electrode is connected to the second node n2 and the other is supplied with the high-potential supply voltage Vdd, thereby maintaining the voltage of the second node n2. Here, the second storage capacitor Cst2 is an optional element. That is, the second storage capacitor Cst2 may be omitted.

The second, third, and fourth switching transistors T2, T3, and T4 are n-channel transistors made of an oxide semiconductor, and the fifth and sixth switching transistors T5 and T6 and the driving transistor DT are p-channel transistors made of amorphous silicon.

In the case of p-channel transistors, the gate-on voltage to turn on the transistors is a gate low voltage VGL and the gate-off voltage to turn off the transistors is a gate high voltage VGH. In the case of n-channel transistors, the gate-on voltage to turn on the transistors is a gate high voltage VGH and the gate-off voltage to turn off the transistors is a gate low voltage VGL.

Figure 3:
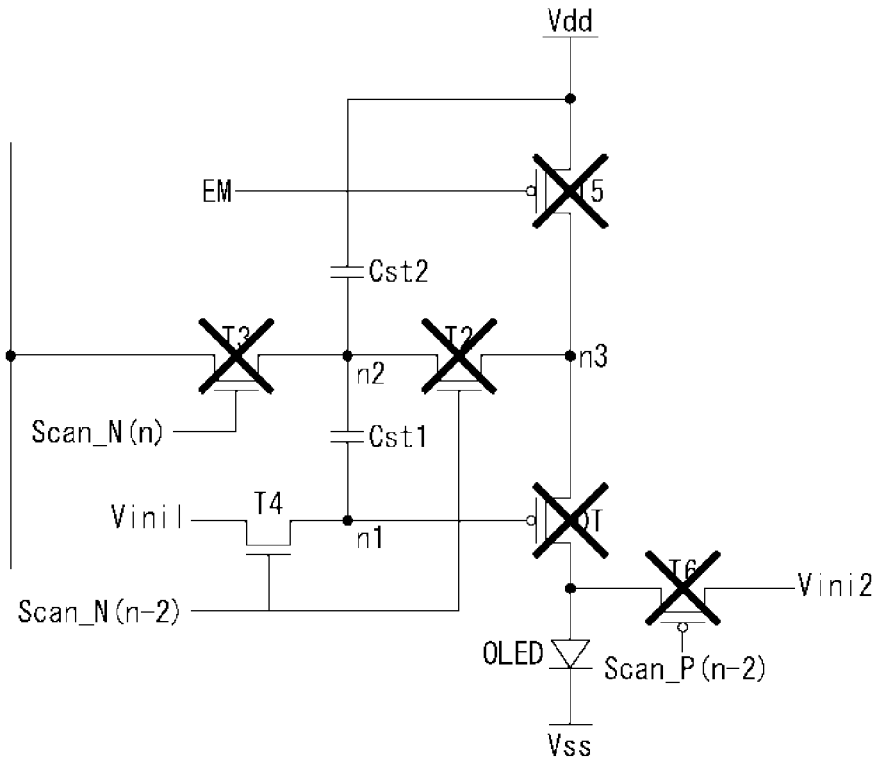
FIGS. 3 to 6 are views illustrating a method of driving the pixel circuit of FIG. 2 while correcting a threshold voltage of a driving transistor.
Figure 3:
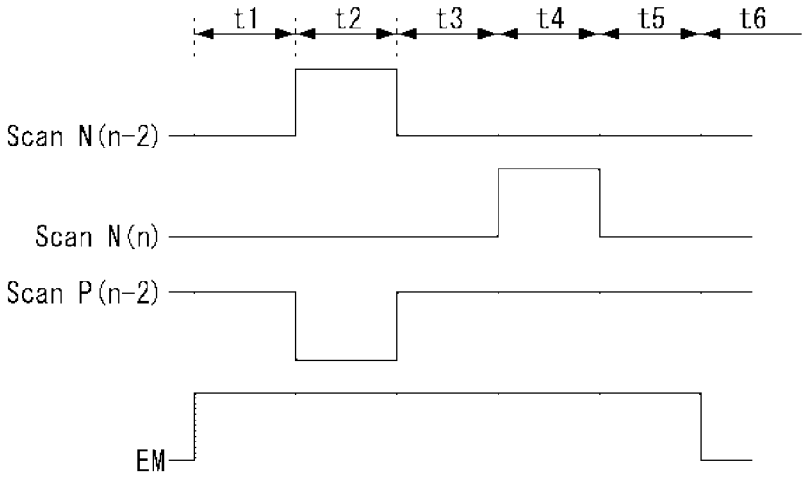
Figure 4:
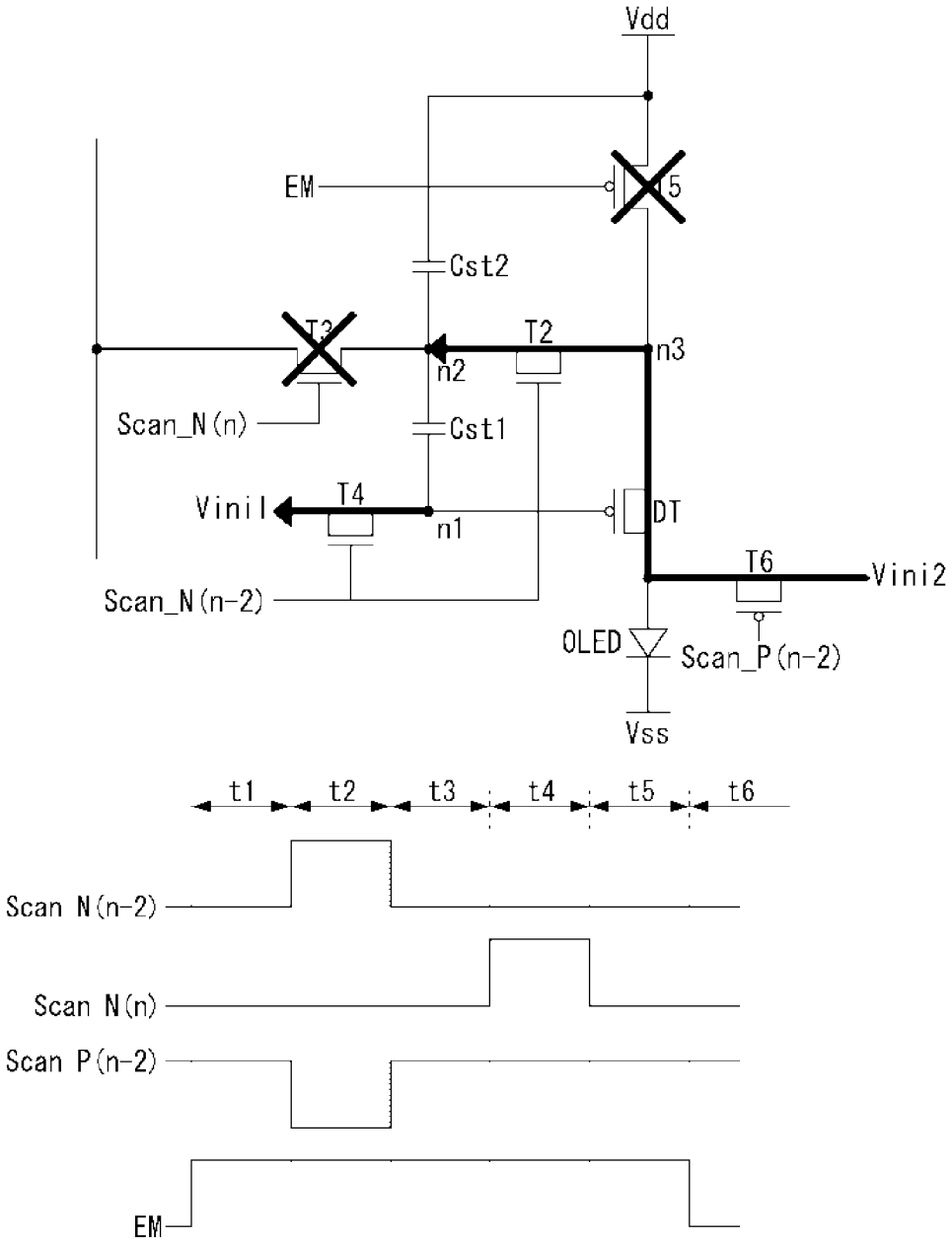
Figure 5:
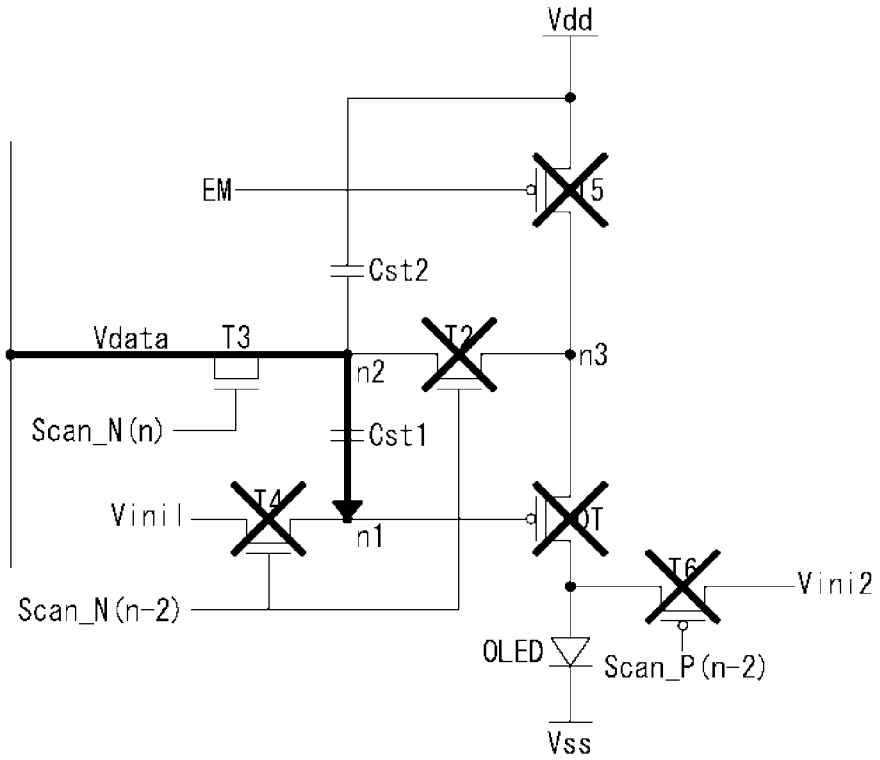
Figure 5:
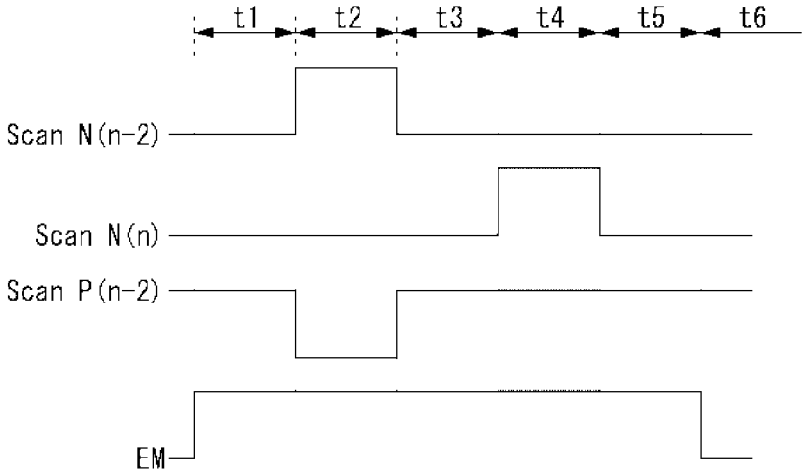
Figure 6:
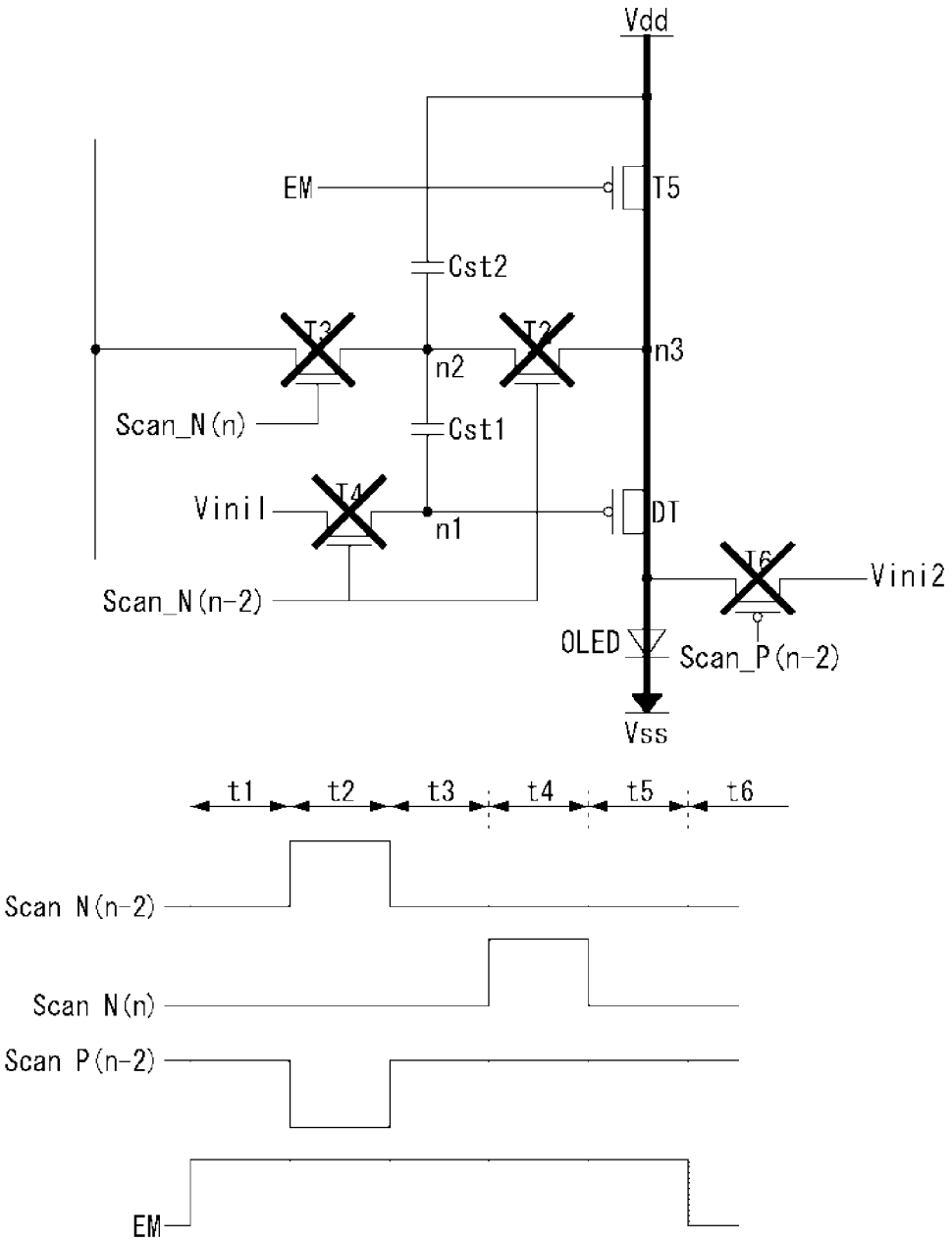

FIGS. 3 to 6 illustrate steps of driving the pixel circuit of FIG. 2 while compensating for a change in the threshold voltage of the driving transistor. FIG. 3 illustrates a non-emission period in which light emission is not performed, and FIG. 4 illustrates an initialization period and a sensing period. FIG. 5 illustrates a data recording period, and FIG. 6 illustrates an emission period.

The second scan signal Scan_N(n) is a control signal for supplying a data voltage to pixels of the n-th horizontal line (called current pixel line), and the first scan signal Scan_N (n−2) is a control signal for supplying a data voltage to the pixels of the (n−2)-th horizontal line that is two pixel lines ahead of the current pixel line. Therefore, the second scan signal Scan_N(n) is two horizontal scan periods H later than the first scan signal Scan_N(n−2).

The third scan signal Scan_P(n−2) is a control signal for initializing the anode electrodes of the OLEDs prior to applying the data voltage to the current pixel line. The third scan signal Scan_P(n−2) is the same as the first scan signal Scan_N(n−2) in terms of timing but is inverse to the first scan signal Scan_N(n−2) in terms of phase.

In a first period t1 corresponding to a non-emission period, referring to FIG. 3, the first, second, and third scan signals Scan_N(n−2), Scan_N(n), and Scan_P(n−2) and the emission signal EM are all at the gate-off voltage. In this period, the second to sixth switching transistors T2 to T6 and the driving transistor DT are all turned off, and the voltage states of the first to third nodes n1 to n3 are maintained or cannot be determined.

In a second period t2 corresponding to the initialization period and the sensing period, referring to FIG. 4, the first and third scan signals Scan_N(n−2) and Scan_P(n−2) are at the gate-on voltage, and the second scan signal Scan_N(n) and the emission signal EM are at the gate-off voltage. The second, fourth, and sixth switching transistors T2, T4, and T6 are turned on by the gate-on voltage of the first and third scan signals Scan_N(n−2) and Scan_P(n−2). In this period, the first initialization voltage Vini1 is supplied to the first node n1 through the fourth switching transistor T4, and electric current flows to the second node n2 through the second and sixth switching transistors T2 and T6.

The second initialization voltage Vini2 has a higher level than the first initialization voltage Vini1. Therefore, in the second period, the voltage of the first node n1 (i.e., the gate electrode of the driving transistor DT that is a p-channel transistor) is lower than the voltage of the anode electrode of the OLED. Therefore, the driving transistor DT is turned on. That is, the current flows along a direction from the sixth switching transistor T6 to the driving transistor DT to the second switching transistor T2 or in the opposite direction. As a result, the potential of the second node n2 or the third node n3 changes until the driving transistor DT is turned off. That is, the potential of the second node n2 or the third node n3 becomes lower than the potential of the first node n1 by the threshold voltage of the driving transistor DT.

Therefore, when at the end of the second period t2, the first node n1 is at the first initialization voltage Vini1, and the second node n2 is at a voltage Vini1−Vth that is lower than the first initialization voltage Vini1 by the threshold voltage Vth of the driving transistor DT. Therefore, the threshold voltage Vth of the driving transistor DT is stored in the first storage capacitor Cst1.

At the beginning of the second period t2, the potential of the first node n1 immediately becomes the first initialization voltage Vini1, and a potential difference between the high-potential drive voltage Vdd and the first initialization voltage Vini1 of the first node n1 is distributed between the first storage capacitor Cst1 and the second storage capacitor Cst2. Thus, the distributed potential is immediately measured from the second node n2. Thereafter, the potential of the second node n2 becomes the voltage Vini1−Vth that reflects the first initialization voltage Vini1 and the threshold voltage Vth of the driving transistor due to the current caused by the second initialization voltage Vini2. Therefore, the settling time of the potential of the second node n2 is not long.

In a third period t3 that follows the second period t2, the same scan signal and the same emission signal as those input during the first period t1 are input again so that the switching transistors are turned off. In this period, the voltage states of the first node n1 and the second node n2 are maintained by the first and second storage capacitors Cst1 and Cst2. The third period t3 is a period in which the scan signal Scan_N(n−2) for applying a data voltage to the pixels of the (n−1)-th pixel line is supplied.

In a fourth period t4 corresponding to a data recording period, referring to FIG. 5, the second scan signal Scan_N(n) is at the gate-on voltage, and the other scan signal and the emission signal are at the gate-off voltage. The third switching transistor T3 is turned on by the second scan signal Scan_N(n) having the gate-on voltage so that the second node n2 is supplied with the data voltage Vdata.

Since the potential of the second node n2 becomes the data voltage Vdata while the potential difference between the electrodes of the first storage capacitor Cst1 is maintained, the potential of the first node n1 becomes a voltage (Vdata+Vth) that is the sum of the data voltage Vdata and the threshold voltage Vth of the driving transistor DT.

By storing the threshold voltage Vth of the driving transistor DT in the first storage capacitor Cst1 during the second period t2 prior to supplying the data voltage Vdata, the amount of charge accumulated in the capacitor Cst1 does not change, but only the potentials of the respective electrodes of the first storage capacitor Cst1 change at the same rate during the fourth period t4. Therefore, during the fourth period t4, the time that the first node n1 takes to be settled to the data voltage Vdata reflecting the threshold voltage is reduced.

In a fifth period t5 that follows the fourth period, the same scan signal and the same emission signal as those input within the first period t1 or the third period t3 are input again. Thus, the switching transistors are turned off and the voltage states of the first node n1 and the second node n2 are maintained by the first and second storage capacitors Cst1 and Cst2.

In a sixth period t6 corresponding to an emission period, the first, second, and third scan signals Scan_N(n−2), Scan_N(n), and Scan_P(n−2)) are at the gate-off voltage, and the emission signal EM is at the gate-on voltage. All of the second to sixth switching transistors T2 to T6 are turned off, the high-potential supply voltage Vdd is input to the third node n3, and the first node n1 maintains a voltage (Vdata+Vth) that is lower than the high-potential supply voltage Vdd. Therefore, the driving transistor DT is turned on to pass a pixel current capable of causing the light emission of the OLED.

A current I_OLED flowing through the driving transistor DT is proportional to the square of a value obtained by subtracting the threshold voltage Vth from the gate-source voltage Vgs of the driving transistor DT, and can be expressed as Expression 1 below.

$$I_OLED \propto (Vgs-Vth)^2=((Vdata+Vth)-Vdd-Vth)^2=(Vdd-Vdata)^2 \quad \text{[Expression 1]}$$

As shown by Expression 1, since the threshold voltage Vth component of the driving transistor DT is eliminated in the relational expression of the driving current I_OLED, even though the threshold voltage of the driving transistor DT changes, the OLED can perform light emission according to a current corresponding to the data voltage Vdata input through the data line while compensating for the change in the threshold voltage of the driving transistor.

The third period t3 and the fifth period t5 are called sustain periods or hold periods in which all of the switching transistors are turned off and each node maintains the same voltage as that in their immediately previous period. There may be a case where the third period t3 is fixed to one horizontal period and the fifth period t5 is omitted. In this case, the sixth period immediately starts at the end of the fourth period so that the pixels of the corresponding pixel line immediately emit light. Alternatively, the sixth period may not start until the data voltage is applied to all of the pixel lines so that the pixels of all of the pixel lines can simultaneously emit light.

Figure 7:
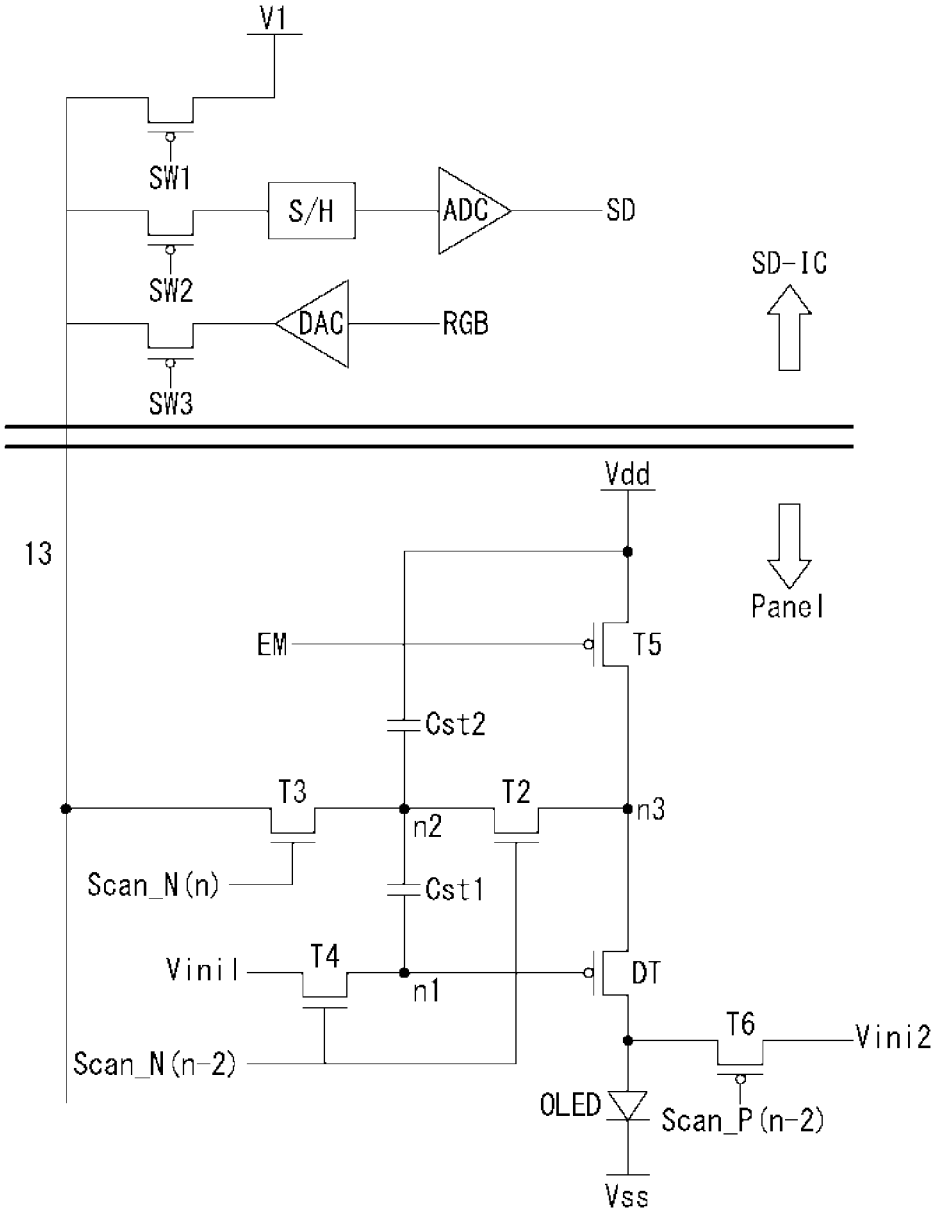
FIG. 7 is a view illustrating a sensing circuit for sensing a threshold voltage of a switching transistor included in the pixel circuit of FIG. 2.
Figure 8:
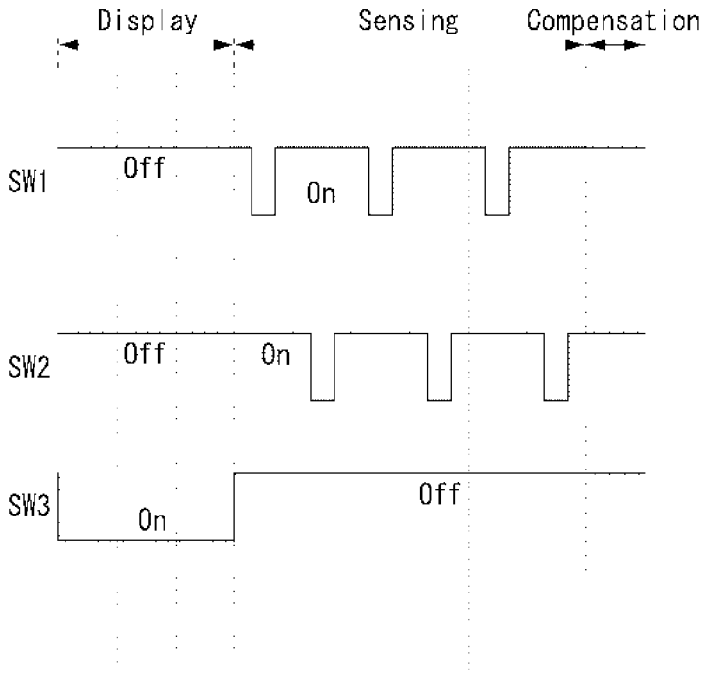
FIG. 8 is a view illustrating a switching operation for controlling connection between the pixel circuit of FIG. 2 and the sensing circuit of FIG. 7.

FIG. 7 illustrates a sensing circuit that detects the threshold voltage of a switching transistor included in the pixel circuit of FIG. 2, and FIG. 8 illustrates an operation of switching between connection and disconnection between the pixel circuit of FIG. 2 and the sensing circuit of FIG. 7.

When the pixel circuit of FIG. 2 is driven, a gate-off voltage VGL is applied to the gate electrodes of the second, third, and fourth switching transistors T2, T3, and T4, which are oxide thin film transistors (TFTs). Therefore, the second, third, and fourth switching transistors T2, T3, and T4 deteriorate with time. As a result, the threshold voltages of the second, third, and fourth switching transistors T2, T3, and T4 change. Particularly, since the third switching transistor T3 supplies the data voltage of the data line 13 to the second node n2, deterioration of the third switching transistor T3 directly results in a change in the gray scale level to be expressed by the corresponding pixel.

Therefore, the threshold voltages of the respective switching transistors constituting the pixel circuit of FIG. 2 must be detected and corrected.

According to one aspect of the present disclosure, in order to detect the threshold voltages of the third and fourth switching transistors T3 and T4 by using the data line 13, a source drive integrated circuit (SDIC) included in the data driving circuit 12 may further include a power source (or voltage input terminal) that supplies a predetermined voltage V1 to the data line 13, a sample and hold unit (S/H) that detects the voltage of the data line and converts the detected voltage into digital data, and an analog-to-digital converter (ADC).

The V1 voltage source and the ADC may be integrated into the source drive IC or may be configured separately from the source drive IC.

In the configuration of FIG. 7, the data line 13 serves as a passage through which the data voltage is supplied from the DAC of the source drive IC to the pixels. In order to sense the threshold voltages of the switching transistors T2 and T3 which constitute the pixel circuit, the data line 13 is charged to the predetermined voltage V1 or the threshold voltage of one of the switching transistors and transfers the threshold voltage to the ADC of the source drive IC.

Accordingly, referring to FIG. 8, the timing controller 11 drives the display device such that one frame is displayed through a display step, a sensing step of sensing a threshold voltage, and a compensation step of compensating a data voltage. Alternatively, the compensation step may be merged with the display step.

In addition, in order to differently use the data line 13 in the display step and the sensing step, first, second, and third switches SW1, SW2, and SW3 are provided. The first, second, and third switches SW1, SW2, and SW3 control connection between the data line 13 and each of the voltage source of the predetermined voltage V1, the sample and hold unit, and the DAC.

That is, the first switch SW1 is provided between the voltage source of the predetermined voltage V1 and the data line 13, the second switch SW2 is provided between the sample and hold unit and the data line 13, and the third switch SW3 is provided between the DAC and the data line 13.

In FIG. 7, the sample and hold unit and the ADC are collectively termed as a sensing circuit that senses the threshold voltage of the switching transistor and outputs sensing data. Alternatively, the sensing circuit may further include the voltage source of the predetermined voltage V1 and the first to third switches SW1 to SW3.

Figure 9:
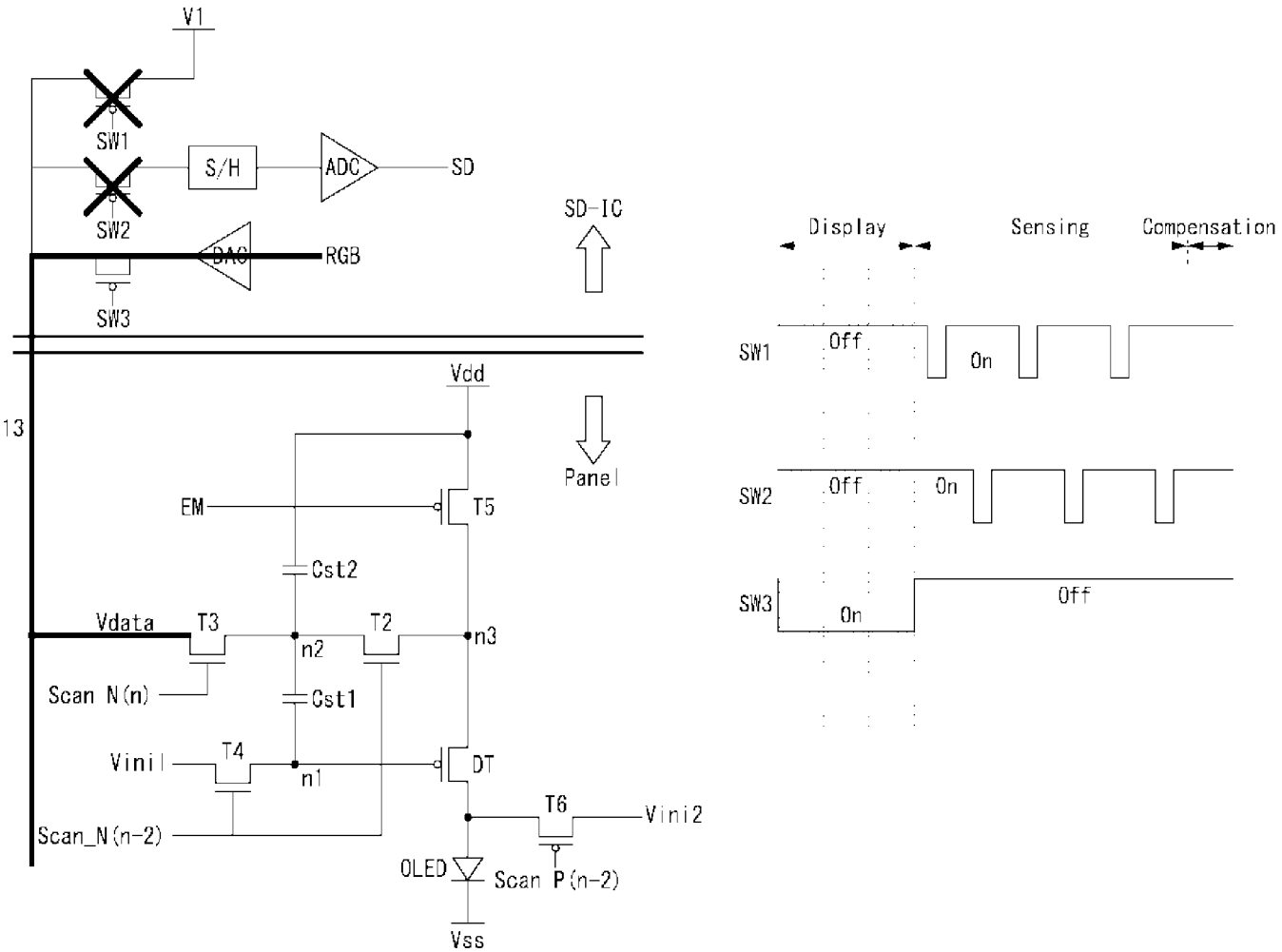
FIG. 9 is a view illustrating a display step in which the circuit of FIG. 7 is used to cause the pixel circuit to display an image.
Figure 10:
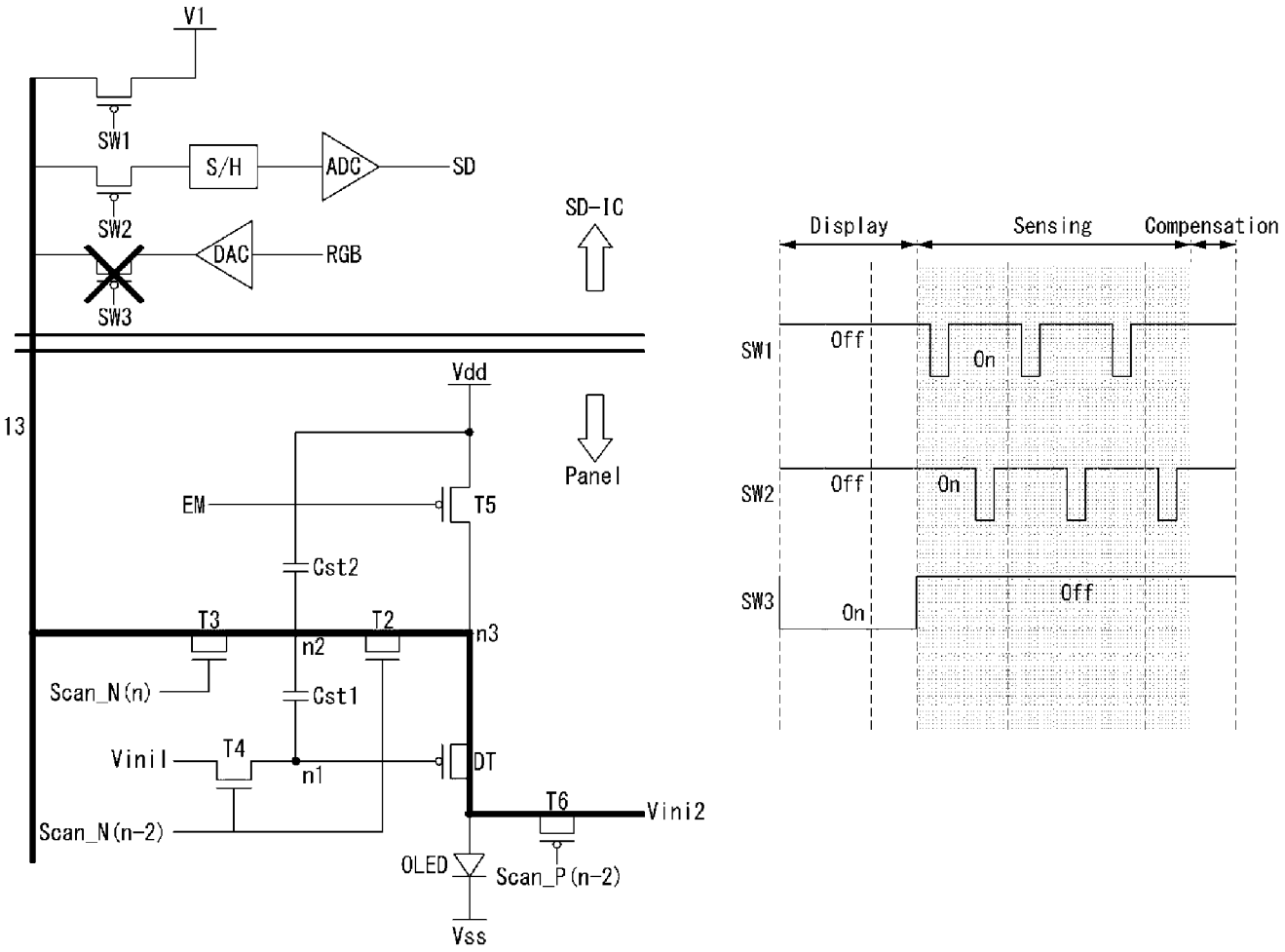
FIG. 10 is a view illustrating a sensing step in which the circuit of FIG. 7 detects threshold voltages of respective switching transistors included in the pixel circuit.

FIG. 9 illustrates an operation of the circuit of FIG. 7 in the display step in which an image is displayed by the pixel circuit. FIG. 10 illustrates an operation of the circuit of FIG. 7 in the sensing step in which the threshold voltage of the switching transistor included in the pixel circuit is sensed.

In the display step, referring to FIG. 9, the first and second switches SW1 and SW2 are turned off by off-control signals so that the data line 13 is disconnected from the sample and hold unit and the voltage source of the predetermined voltage V1 of the source drive IC, and the third switch SW3 is turned on by an on-control signal so that the DAC of the source drive IC can supply the image data RGB as the data voltage Vdata to the pixels through the data line 13.

In the sensing step, referring to FIG. 10, the third switch SW3 is turned off by an off-control signal so that the data line 13 is disconnected from the DAC of the source drive IC. The first and second switches SW1 and SW2 receive on-control signals and off-control signals in a predetermined order. Through this operation, the data line 13 is charged to the predetermined voltage V1 or to a voltage related to the threshold voltage of the third switching transistor T3 or the second switching transistor T2. The voltage related to the threshold voltage is measured from the data line 13.

That is, the data line 13 is charged to the predetermined voltage V1 while the first switch SW1 is on, the voltage of the data line 13, which is related to the threshold voltage of the third switching transistor T3 or the second switching transistor T2 is sampled by the sample and hold unit of the source drive IC while the second switch SW2 is on, and the sampled voltage is output as sensing data AD from the ADC.

In the compensation step, the timing controller 11 calculates the threshold voltage of the switching transistor on the basis of the sensing data SD detected from the pixel and transmitted from the source drive IC. Before the image data RGB is transmitted to the source drive IC, the image data RGB is corrected to reflect the calculated threshold voltage. The corrected image data RGB is output.

Figure 11:
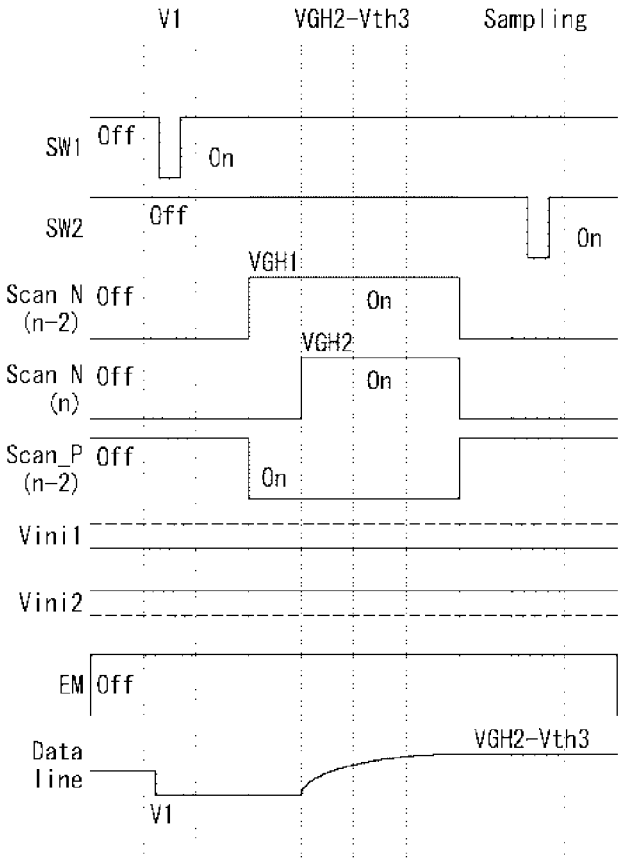
FIG. 11 is a timing chart illustrating control signals for controlling switching transistors and node voltages that change with time in the sensing step.

FIG. 11 is a timing chart of control signals for controlling switching transistors and node voltages in the sensing step of FIG. 10.

The sensing step is divided into a first charging period V1 during which the data line 13 is charged to the predetermined voltage V1, a second charging period during which the data line 13 is charged to the voltage (VGH2−Vth3) related to the threshold voltage of the third switching transistor T3, and a sampling period during which the voltage of the data line 13 is sampled.

Figure 12:
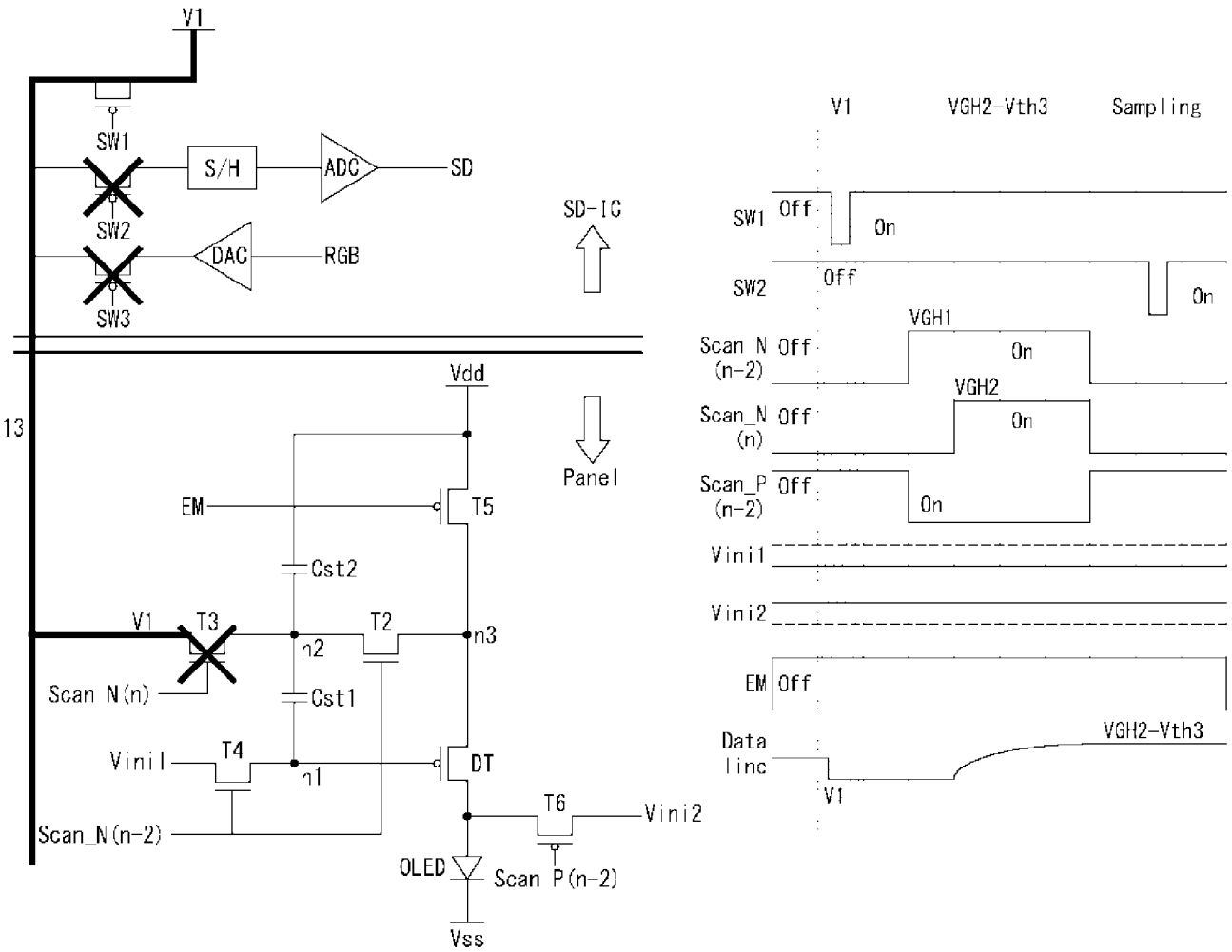
FIG. 12 is a view illustrating an operation during a first charging period within which a data line is charged to a predetermined voltage V1, in the timing charge of FIG. 11.

In regard to the timing chart of FIG. 11, FIG. 12 particularly illustrates a circuit operation during the first charging period during which the data line is charged to the predetermined voltage V1.

During the first charging period for charging to the predetermined voltage V1, the first switch SW1 is turned on and then turned off, and the second switch SW2 remains off. In addition, all of the first to third scan signals Scan_N(n−2), Scan_N(n), Scan_P(n−2)) and the emission signal EM are at a gate-off voltage. When the first switch SW1 is turned, the data line 13 is connected to the voltage source of the predetermined voltage V1 so as to be charged to the predetermined voltage V1.

Figure 13:
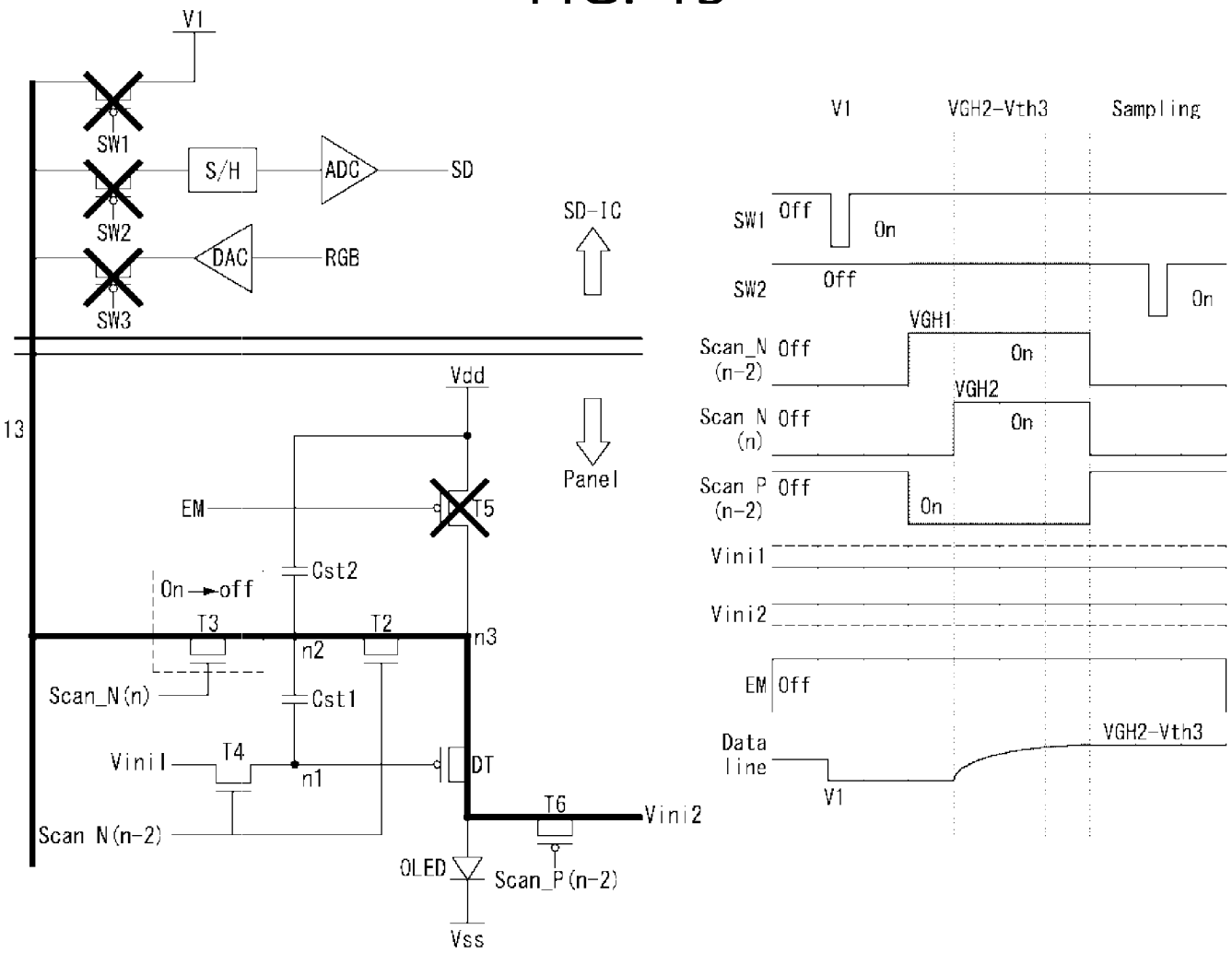
FIG. 13 is a view illustrating an operation during a second charging period within which the data line is charged to a threshold voltage of a third switching transistor, in the timing chart of FIG. 11.

In regard to the timing chart of FIG. 11, FIG. 13 particularly illustrates a circuit operation during the second charging period during which the data line is charged to the threshold voltage of the third switching transistor.

During the second charging period for charging to the voltage VGH2−Vth3, the first and second switches SW1 and SW2 remain off. Therefore, the data line 13 is disconnected from the voltage source of the predetermined voltage V1 and the sample and hold unit. The first, second, and third scan signals Scan_N(n−2), Scan_N(n), and Scan_P(n−2)) and the emission signal EM are input in a predetermined order.

The emission signal EM remains at the gate-off voltage. In addition, both the first initialization voltage Vini1 and the second initialization voltage Vini2 are maintained. The first initialization voltage Vini1 is set to be lower than the second initialization voltage Vini2, and the second initialization voltage Vini2 has a level similar to the high-potential supply voltage Vdd.

First, when the first and third scan signals Scan_N(n−2) and Scan_P(n−2) swing to a gate-on voltage, the second, fourth, and sixth switching transistors T2, T4, and T6 are turned on, the potential of the first node n1, which is the gate electrode of the driving transistor DT, becomes the first initialization voltage Vini1, and the potential of the anode electrode of the OLED becomes the second initialization voltage Vini2. Therefore, the potential of the gate electrode of the driving transistor DT becomes lower than the potential of the first/second electrode of the driving transistor DT, and the driving transistor DT is turned on. Accordingly, the potentials of the third node n3 and the second node n2 become the second initialization voltage Vini2.

Since the flow of current through the driving transistor DT occurs in a direction from the OLED's anode side to the third node side, light is not emitted from the OLED.

Thereafter, when the second scan signal Scan_N(n) changes to the gate-on voltage, a conduction path is formed such that the data line 13 is connected to a second initialization line that supplies the second initialization voltage Vini2 through the third switching transistor T3, the second switching transistor T2, and the driving transistor DT, and the sixth switching T6. Therefore, the voltage of the data line 13 rises from the predetermined voltage V1 due to the second initialization voltage Vini2 that is a level similar to the high-potential supply voltage Vdd.

At this time, the gate-on voltage of the first scan signal Scan_N(n−2) is different from the gate-on voltage of the second scan signal Scan_N(n). Particularly, a first gate-on voltage VGH1 that is the gate-on voltage of the first scan signal Scan_N(n−2) is set to be higher than a second gate-on voltage VGH2 that is the gate-on voltage of the second scan signal Scan_N(n).

When the voltage of the data line 13 (or the voltage of the second node n2) rises to reach a level VGH2−Vth3 that is lower than the second gate-on voltage VGH2 applied to the gate electrode of the third switching transistor T3 by the threshold voltage Vth3 of the third switching transistor T3, the third switching transistor T3 is turned off (On→Off). Thereafter, the rise of the voltage of the data line 13 stops at the level VGH2−Vth3 that reflects the threshold voltage Vth3 of the third switching transistor T3.

Since the first gate-on voltage VGH1 having a level higher than that of the second gate-on voltage VGH2 is applied to the gate electrode of the second switching transistor T2, even though the voltage of the data line 13 or the second node n2 becomes the level VGH2−Vth3, the difference between the voltage VGH1 of the gate electrode of the second switching transistor T2 and the voltage VGH2−Vth3 of the second node n2 is greater than the threshold voltage Vth2 of the second switching transistor T2. Therefore, the second switching transistor T2 is not turned off.

Figure 14:
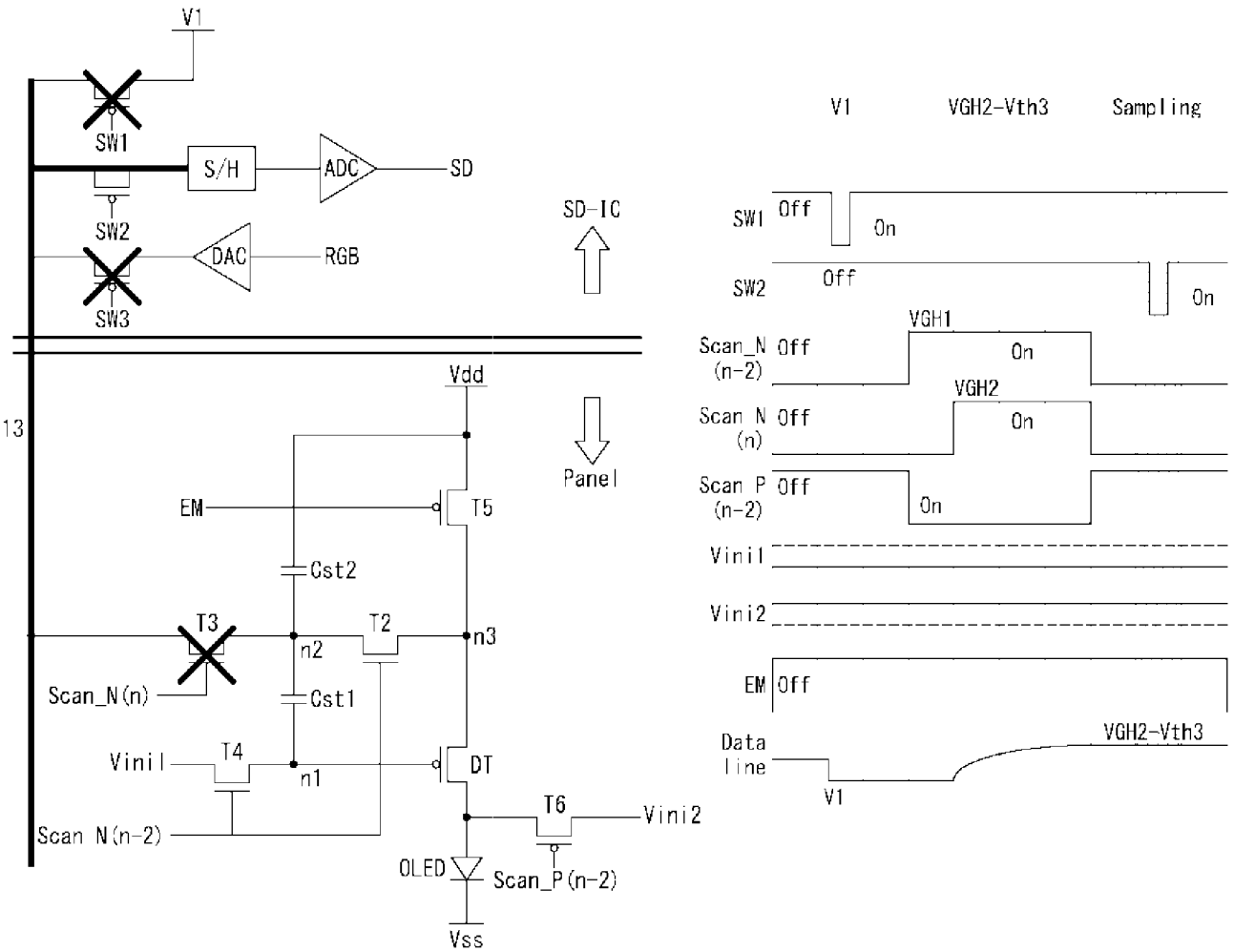
FIG. 14 is a view illustrating an operation during a sampling period within which the threshold voltage of the third switching transistor is sampled on the basis of the voltage of the data line.

FIG. 14 illustrates a circuit operation during the sampling period during which the threshold voltage of the third switching transistor, which is charged on the data line, is sampled.

During the sample period, the first switch SW1 remains off, and the second switch SW2 is first turned on and then turned off, and the first to third scan signals Scan_N(n−2), Scan_N(n), Scan_P(n−2) and the emission signal EM are at the gate-off voltage. When the second switch SW2 is turned on, the sample and hold unit is connected to the data line 13 so that the voltage VGH2−Vth3 of the data line 13 on which the threshold voltage Vth3 of the third switching transistor T3 is reflected is sampled and held. Next, the ADC converts the sampled voltage into sensing data SD.

Therefore, the threshold voltage Vth3 of the third switching transistor T3 can be determined on the basis of the voltage of the data line 13.

Similarly, when measuring the threshold voltage Vth3 of the third switching transistor T3, in a case where the second initialization voltage Vini2 is set as the gate-on voltage VGH2 of the second scan signal Scan_N(n), and the gate-on voltage VGH1 of the first scan signal Scan_N(n−2) is set to be higher than the gate-on voltage VGH2 of the second scan signal Scan_N(n), until the voltage of the data line 13 rises to the voltage VGH2−Vth3, the second switching transistor T2 is not turned off but the third switching transistor T3 is turned off. Therefore, the data line 13 is charged to the voltage VGH2−Vth3.

Figure 15:
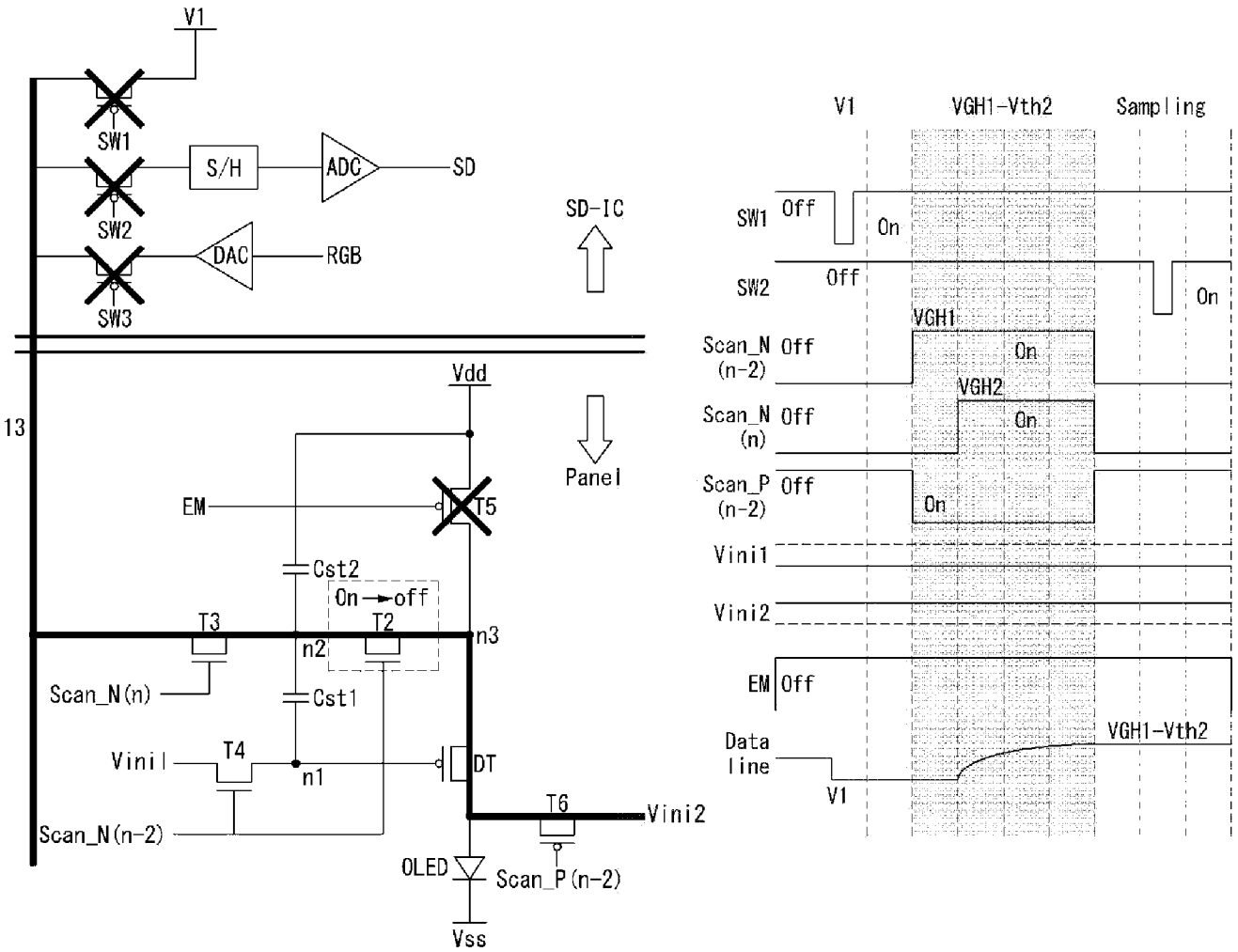
FIG. 15 is a view illustrating an operation of sensing a threshold voltage of a second switching transistor.

FIG. 15 illustrates an operation of sensing the threshold voltage of the second switching transistor.

The operation of FIG. 15 is the same as the operation of FIG. 13 except for a point that the second gate-on voltage VGH2 of the second scan signal Scan_N(n) is set to be higher than the first gate-on voltage VGH1 of the first scan signal Scan_N(n−2).

That is, the voltage of the data line 13 (or the voltage of the second node n2 or the third node n3) rises to a level VGH1−Vth2 that is lower than the first gate-on voltage VGH1 applied to the gate electrode of the second switching transistor T2 by the threshold voltage Vth2 of the second switching transistor T2, the second switching transistor T2 is turned off (On→Off). Therefore, the rise of the voltage of the data line 13 stops at the voltage VGH1−Vth2 on which the threshold voltage Vth2 of the second switching transistor T2 is reflected.

Since the second gate-on voltage VGH2 having a higher level than the first gate-on voltage VGH1 is supplied to the gate electrode of the third switching transistor T3, although the voltage of the data line 13 or the second node n2 becomes the level VGH1−Vth2, since the difference between the voltage VGH2 of the gate electrode of the third switching transistor T3 and the voltage VGH1−Vth2 of the second node n2 is greater than the threshold voltage Vth3 of the third switching transistor T3, the third switching transistor T3 is not turned off.

During the sampling period, the second switch SW2 is turned on and the sample and hold unit samples and holds the charged voltage VGH1−Vth2 that reflects the threshold voltage Vth2 of the second switching transistor T2. Next, the ADC converts the sampled voltage VGH1−Vth2 into sensing data SD and transmits the sensing data SD to the timing controller 11.

Alternatively, when measuring the threshold voltage Vth2 of the second switching transistor T2, the second initialization voltage Vini2 is set as the gate-on voltage VGH1 of the first scan signal Scan_N(n−2) and the gate-on voltage VGH2 of the second scan signal Scan_N(n) is set to be higher than the gate-on voltage VGH1 of the first scan signal Scan_N(n−2). In this case, when the voltage of the second node n2 rises to the voltage VGH1−Vth2, the third switching transistor T3 is not turned off but the second switching transistor T2 is turned off. Therefore, the data line 13 is charged to the voltage VGH1−Vth2.

Accordingly, with the use of the second initialization voltage Vini2, it is possible to charge the data line 13 to a voltage that reflects the threshold voltage of a switching transistor.

Figure 16:
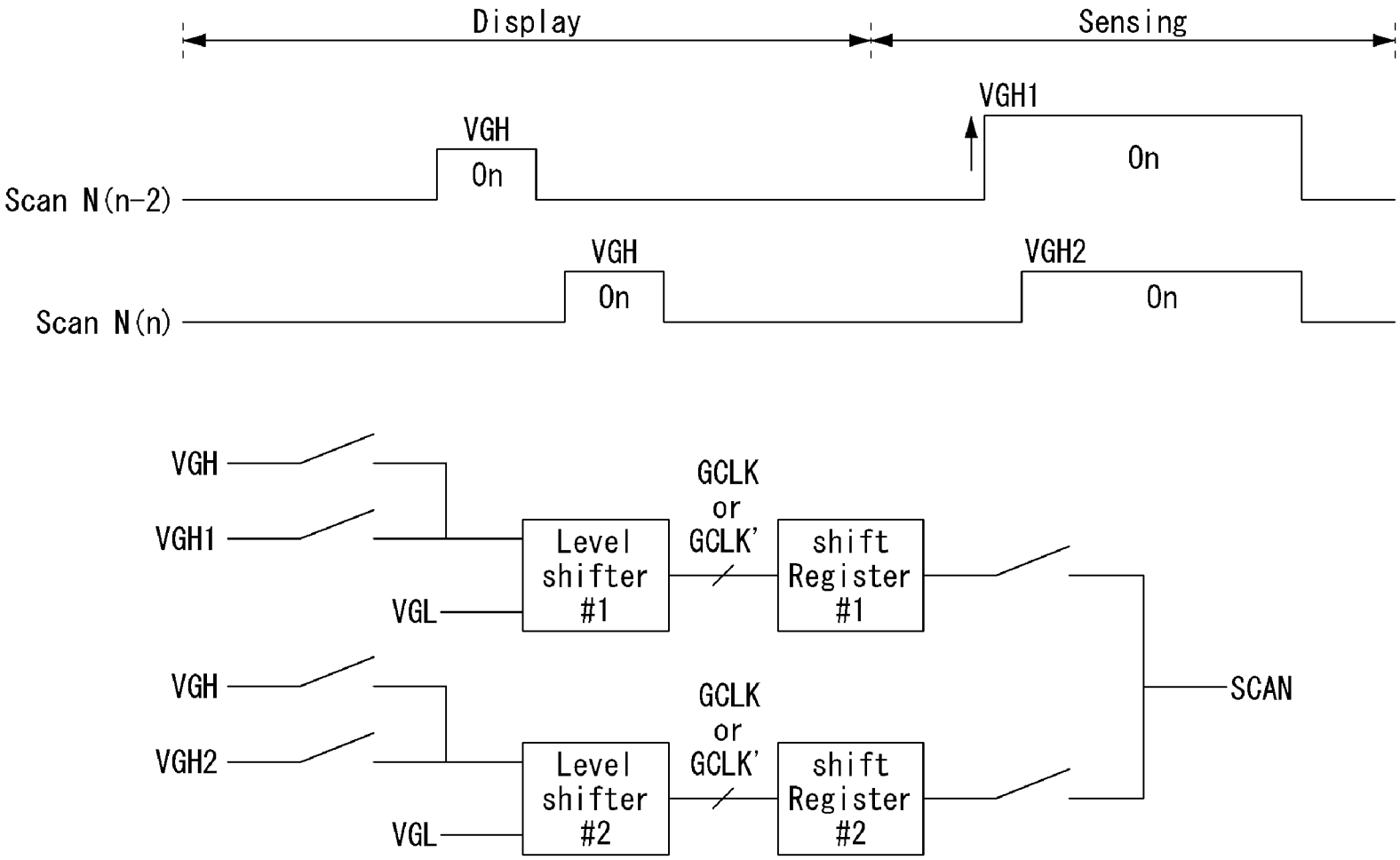
FIG. 16 is a diagram illustrating the levels of control signals for controlling the second and third switching transistors in the display step and the sensing step and a component that generates the control signals.

FIG. 16 illustrates levels of control signals for controlling second and third switching transistors in a display step and a sensing step and illustrates a configuration for generating such control signals.

In the display step, the first scan signal Scan_N(n−2) and the second scan signal Scan_N(n) that have the gate-on voltage are sequentially output with an interval of two horizontal periods 2H therebetween. The period in which the first scan signal Scan_N(n−2) having the gate-on voltage is output does not overlap the period in which the second scan signal Scan_N(n) having the gate-on voltage is output.

In the sensing step, the first scan signal Scan_N(n−2) having the gate-on voltage is first output, and then the second scan signal Scan_N(n) having the gate-on voltage is output. In this step, the period in which the first scan signal Scan_N(n−2) having the gate-on voltage is output overlaps the period in which the second scan signal Scan_N(n)

having the gate-on voltage is output, and the two scan signals simultaneously change to the gate-off voltage.

In the sensing step, in order to charge the data line 13 to the threshold voltage Vth3 of the third switching transistor T3, the gate-on voltage VGH1 of the first scan signal Scan_N(n−2) is set to be higher than the gate-on voltage VGH2 of the second scan signal Scan_N(n). On the other hand, in order to charge the data line 13 to the threshold voltage Vth2 of the second switching transistor T2, the gate-on voltage VGH1 of the first scan signal Scan_N(n−2) is set to be lower than the gate-on voltage VGH2 of the second scan signal Scan_N(n).

Either one or both of the gate-on voltage VGH1 of the first scan signal Scan_N(n−2) and the gate-on voltage VGH2 of the second scan signal Scan_N(n), which are used in the sensing step, may be different from the gate-on voltage of the first scan signal Scan_N(n−2) and the gate-on voltage of the second scan signal Scan_N(n), which are used in the display step.

That is, when charging the data line 13 to the threshold voltage Vth3 of the third switching transistor T3, the gate-on voltage VGH2 of the second scan signal Scan_N(n) may be set to the same voltage as the gate-on voltage VGH of the second scan signal Scan_N(n) or the first scan signal Scan_N(n−2) used in the display step, and the gate-on voltage VGH1 of the first scan signal Scan_N(n−2) may be set to a higher voltage than the gate-on voltage VGH used in the display step.

Alternatively, when charging the data line 13 to the threshold voltage Vth3 of the third switching transistor T3, the gate-on voltage VGH1 of the first scan signal Scan_N (n−2) may be set to the same voltage as the gate-on voltage VGH of the first scan signal Scan_N(n−2) or the second scan signal Scan_N(n) used in the display step, and the gate-on voltage VGH2 of the second scan signal Scan_N(n) may be set to a lower voltage than the gate-on voltage VGH used in the display step.

Similarly, when charging the data line 13 to the threshold voltage Vth2 of the second switching transistor T2, the gate-on voltage VGH2 of the first scan signal Scan_N(n−2) may be set to the same voltage as the gate-on voltage VGH of the first scan signal Scan_N(n−2) (or the second scan signal Scan_N(n)) used in the display step, and the gate-on voltage VGH2 of the second scan signal Scan_N(n) may be set to a higher voltage than the gate-on voltage VGH used in the display step.

Alternatively, when charging the data line 13 to the threshold voltage Vth2 of the second switching transistor T2, the gate-on voltage VGH2 of the second scan signal Scan_N(n) may be set to the same voltage as the gate-on voltage VGH of the second scan signal Scan_N(n) (or the first scan signal Scan_N(n−2)) used in the display step, and the gate-on voltage VGH1 of the first scan signal Scan_N (n−2) may be set to a lower voltage than the gate-on voltage VGH used in the display step.

In this case, as the gate-on voltages of the scan signals, only two voltages including the gate-on voltage VGH used in the display step and the gate-on voltage VGH1/VGH2 used in the sensing step may be used.

To this end, the gate driving circuit 14 is provided with two or more level shifters and shift registers to generate clock signals GCLK and GCLK' of different levels and scan signals of different gate-on voltage levels VGH and VHG1/VGH2. A switch may be used to output the scan signals of different gate-on voltage levels in the display step and the sensing step, respectively. In the sensing step, the first scan signal Scan_N(n−2) and the second scan signal Scan_N(n) may be set to have different gate-on voltage levels, for example, VGH and VGH1, VGH and VGH2, or VGH1 and VGH2.

Although the illustration of FIG. 16 shows that voltages VGH, VGH1, VGH2, and VGL are input to the level shifters, reference symbols VGH, VGH1, VGH2, and VGL actually denote the levels of scan signals output from the shift registers. The actual voltages input to the level shifters have values corresponding to the levels VGH, VGH1, VGH2, and VGL, respectively.

Figure 17:
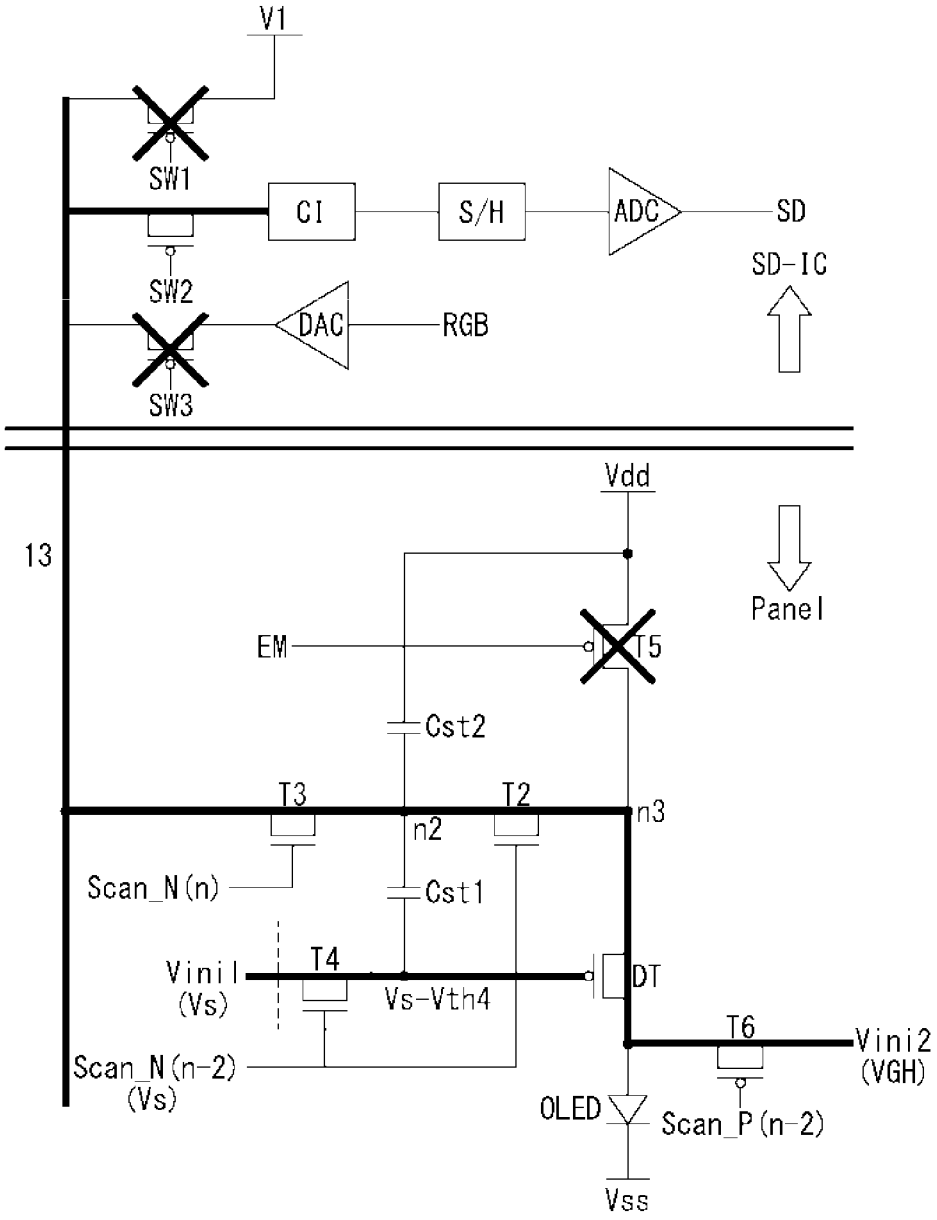
FIG. 17 is a view illustrating an operation of sensing a threshold voltage of a fourth switching transistor.

FIG. 17 illustrates an operation of sensing the threshold voltage of the fourth switching transistor.

Since the fourth switching transistor T4 is not directly connected to the data line 13, the threshold voltage of the fourth switching transistor T4 cannot be sensed through the method which has been described with reference to FIGS. 7 to 16.

In FIG. 17, a voltage reflecting the threshold voltage Vth4 of the fourth switching transistor T4 is applied to the gate electrode of the driving transistor DT or the first node n1, and the current flowing through the driving transistor DT enters the data line 13. The source drive IC senses the current flowing through the data line 13 and outputs it as sensing data SD.

The source drive IC may further include a current integrator (CI) between the data line 13 and the sample and hold unit. The current integrator converts the current flowing through the data line 13 into a voltage.

When sensing the threshold voltage Vth4 of the fourth switching transistor T4, the second scan signal Scan_N(n) and the third scan signal Scan_P(n−2) having the gate-on voltage are applied, and the first scan signal Scan_N(n−2) having a predetermined level Vs is applied. As the first initialization voltage Vini1, the voltage Vs that is the same as the gate-on voltage of first scan signal Scan_N(n−2) is supplied.

Accordingly, the fourth switching transistor T4 is diode-connected so that the first node n1 has a voltage Vs−Vth4 that is lower than the voltage Vs, which is the first initialization voltage Vini1, by the threshold voltage Vth4 of the fourth switching transistor T4.

In addition, the gate-on voltage is supplied to the sixth switching transistor T6 so that the sixth switching transistor is turned on, and the gate high voltage VGH higher than the voltage Vs is supplied as the second initialization voltage Vini2 (or the second scan signal Scan_N(n)). Thus, the anode electrode of the OLED is supplied with the gate high voltage VGH.

Since the voltage Vs−Vth4 of the gate electrode of the driving transistor DT is lower than the gate high voltage VGH of the anode electrode of the OLED, the driving transistor DT is turned on, and a current corresponding to the voltage difference between the anode electrode of the OLED and the gate electrode of the driving transistor DT flows. This current is input to the current integrator through the second and third switching transistors T2 and T3 and the data line 13.

Therefore, the current reflecting the threshold voltage Vth4 of the fourth switching transistor T4 is input to the current integrator, converted into a voltage by the current integrator, and converted into sensing data SD by the sample and hold unit and the ADC. The threshold voltage of the fourth switching transistor T4 can be determined on the basis of the sensing data SD.

The method described with reference to FIGS. 7 to 16 is advantageous in that it is easy to determine the threshold voltage of a switching transistor because the determination is made on the basis of the voltage measured from the data line 13. On the other hand, the method has a disadvantage in that sensing speed is low because the data line 13 needs to be charged to the voltage reflecting the threshold voltage of a switching transistor. That is, since the capacitance of the data line 13 is very large, it takes a long time to charge the data line 13, resulting in a low sensing speed.

The method described with reference to FIG. 17 detects a current flowing through the data line 13. In this case, since a current flowing through the driving transistor of a single pixel is minute, an error may occur when measuring the current flowing through the data line 13 due to noise. However, in the case of measuring the current, sensing speed is fast because there is no need to wait for the data line 13 to be charged to a predetermined voltage.

Accordingly, it is possible to precisely detect the threshold voltages of the switching transistors constituting the pixel circuit, and it is possible to reduce the distortion of the data voltage supplied to the driving transistor, the distortion resulting from the deterioration of the switching transistors. Consequently, the display quality can be improved.

The display device presented in the present disclosure is summarized below.

A display device according to an exemplary aspect includes a display panel having a plurality of pixels each being connected to a gate line and a data line, a data driving circuit for driving the data line, a gate driving circuit for driving the gate line, and a timing controller for controlling operation of the data driving circuit and operation of the gate driving circuit.

Each of the pixels includes: a light-emitting diode; a driving transistor having a second electrode connected to an anode electrode of the light-emitting diode and allowing a driving current corresponding to a data voltage supplied through the data line to flow through the light-emitting diode; a second switching transistor that controls connection between a first electrode of the driving transistor and a second node; a third switching transistor that controls connection between the data line and a second node and which operates according to a second scan signal that is later than a first scan signal that controls operation of a second switching transistor; a fourth switching transistor that controls connection between a first initialization voltage input terminal for supplying a first initialization voltage and a gate electrode of the driving transistor and which operates according to the first scan signal; a fifth switching transistor that controls connection between the first electrode and a first power input terminal for supplying a high-potential supply voltage; a sixth switching transistor that controls connection between a second initialization voltage input terminal for supplying a second initialization voltage and the anode electrode and which operates according to a third scan signal having the same timing as the first scan signal; and a storage capacitor connected between the second node and the gate electrode.

In a sensing step in which the light-emitting diode emits light, a conduction path that is connected through the sixth switching transistor, the driving transistor, the second switching transistor, and the third switching transistor is formed to transfer an electrical signal reflecting a threshold voltage of one of the second, third, and fourth switching transistors to the data line.

In one aspect, when the data line is charged to a second voltage reflecting a second threshold voltage that is a threshold voltage of the second switching transistor, a second gate-on voltage that is a gate-on voltage of the second scan signal may be set to be higher than a first gate-on voltage that is a gate-on voltage of the first scan signal.

The first gate-on voltage may be supplied to the second initialization voltage input terminal.

In one aspect, when the data line is charged to a third voltage reflecting a third threshold voltage that is a threshold voltage of the third switching transistor, a first gate-on voltage that is a gate-on voltage of the first scan signal may be set to be higher than a second gate-on voltage that is a gate-on voltage of the second scan signal.

The second gate-on voltage may be supplied to the second initialization voltage input terminal.

In one aspect, when an electric current reflecting a fourth threshold voltage that is a threshold voltage of the fourth switching transistor is made to flow through the data line, the first gate-on voltage of the first scan signal may be input to the first initialization voltage input terminal, and a voltage higher than the first gate-on voltage may be input to the second initialization voltage input terminal.

In one aspect, during the formation of the conduction path, the fifth switching transistor may be turned off.

In one aspect, at a display step at which the data voltage is supplied to the pixel so that the light-emitting diode emits light, the second, fourth, and sixth switching transistors are turned on during an initialization period and a sensing period so that a first threshold voltage of the driving transistor is stored in the storage capacitor, the third switching transistor is turned on during a data recording period so that the sum of the data voltage and the first threshold voltage is stored in the gate electrode of the driving transistor, and the fifth switching transistor is turned on during a light emission period so that the light-emitting diode emits light.

In one aspect, the second, third, and fourth switching transistors may be oxide transistors using an oxide semiconductor material.

In one aspect, the second, third, and fourth switching transistors may be n-channel transistors and the fifth and sixth switching transistors may be p-channel transistors.

Although the present disclosure has been disclosed for illustrative purposes, those skilled in the art will appreciate that various modifications, additions and substitutions are possible, without departing from the scope and spirit of the disclosure as disclosed in the accompanying claims. Therefore, the scope of the present disclosure is not restricted by the above description but is defined by the accompanying claims.

What is claimed is:

1. A display device comprising:

a display panel comprising a plurality of pixels each being connected to a gate line and a data line;

a data driving circuit configured to drive the data line;

a gate driving circuit configured to drive the gate line; and a timing controller configured to control operation of the data driving circuit and operation of the gate driving circuit, wherein each of the plurality of pixels comprises:

a light-emitting diode;

a driving transistor having a second electrode that is connected to an anode electrode of the light-emitting diode, the driving transistor allowing a driving current corresponding to a data voltage supplied through the data line to flow through the light-emitting diode;

a second switching transistor that controls a connection between a first electrode of the driving transistor and a second node;

a third switching transistor that controls a connection between the data line and the second node and that operates according to a second scan signal that is later than a first scan signal that controls operation of the second switching transistor;

a fourth switching transistor that controls a connection between a first initialization voltage input terminal for supplying a first initialization voltage and a gate electrode of the driving transistor and that operates according to the first scan signal;

a fifth switching transistor that controls a connection between the first electrode and a first power input terminal for supplying a high-potential supply voltage;

a sixth switching transistor that controls a connection between a second initialization voltage input terminal for supplying a second initialization voltage and the anode electrode and that operates according to a third scan signal that has a same timing as the first scan signal; and a storage capacitor connected between the second node and the gate electrode, wherein, during a sensing step in which the light-emitting diode does not emit light, a conduction path that is connected through the sixth switching transistor, the driving transistor, the second switching transistor, and the third switching transistor is formed, and an electrical signal reflecting a threshold voltage of one of the second to fourth switching transistors is transferred to the data line through the conduction path.

2. The display device according to claim 1, wherein when the data line is charged to a second voltage reflecting a second threshold voltage that is a threshold voltage of the second switching transistor, a second gate-on voltage that is a gate-on voltage of the second scan signal is set to be higher than a first gate-on voltage that is a gate-on voltage of the first scan signal.

3. The display device according to claim 2, wherein the first gate-on voltage is supplied to the second initialization voltage input terminal.

4. The display device according to claim 1, wherein when the data line is charged to a third voltage reflecting a third threshold voltage that is a threshold voltage of the third switching transistor, a first gate-on voltage that is a gate-on voltage of the first scan signal is set to be higher than a second gate-on voltage that is a gate-on voltage of the second scan signal.

5. The display device according to claim 4, wherein the second gate-on voltage is supplied to the second initialization voltage input terminal.

6. The display device according to claim 1, wherein when an electric current reflecting a fourth threshold voltage that is a threshold voltage of the fourth switching transistor is made to flow through the data line via the conduction path, a first gate-on voltage that is a gate-on voltage of the first scan signal is input to the first initialization voltage input terminal, and a voltage higher than the first gate-on voltage is input to the second initialization voltage input terminal.

7. The display device according to claim 2, wherein during the formation of the conduction path, the fifth switching transistor is turned off.

8. The display device according to claim 1, wherein in a display step in which the data voltage is supplied to the pixel so that the light-emitting diode emits light, the second switching transistor, the fourth switching transistor, and the sixth switching transistor are turned on during an initialization period and a sensing period so that the first threshold voltage of the driving transistor is stored in the storage capacitor, the third switching transistor is turned on during a data recording period so that a voltage equal to the sum of the data voltage and the first threshold voltage is stored in the gate electrode of the driving transistor, and the fifth switching transistor and the driving transistor are turned on during a light emission period so that the light-emitting diode emits light.

9. The display device according to claim 1, wherein the second, third, and fourth switching transistors are oxide transistors using an oxide semiconductor material.

10. The display device according to claim 9, wherein the second, third, and fourth switching transistors are n-channel transistors and the fifth and sixth switching transistors are p-channel transistors.

11. A pixel of a display device, comprising:

a light-emitting diode;

a driving transistor having a second electrode that is connected to an anode electrode of the light-emitting diode and allowing a driving current corresponding to a data voltage supplied through a data line to flow through the light-emitting diode;

a second switching transistor that controls a connection between a first electrode of the driving transistor and a second node;

a third switching transistor that controls a connection between the data line and the second node and that operates according to a second scan signal that is later than a first scan signal that controls operation of the second switching transistor;

a fourth switching transistor that controls a connection between a first initialization voltage input terminal for supplying a first initialization voltage and a gate electrode of the driving transistor and that operates according to the first scan signal;

a fifth switching transistor that controls a connection between the first electrode and a first power input terminal for supplying a high-potential supply voltage;

a sixth switching transistor that controls a connection between a second initialization voltage input terminal for supplying a second initialization voltage and the anode electrode and that operates according to a third scan signal that has a same timing as the first scan signal; and a storage capacitor connected between the second node and the gate electrode, wherein, during a sensing period in which the light-emitting diode does not emit light, the sixth switching transistor, the driving transistor, the second switching transistor, and the third switching transistor are electrically connected to form a conduction path, and an electrical signal reflecting a threshold voltage of one of the second to fourth switching transistors is transferred to the data line through the conduction path.

* * * * *